US010161664B2

(12) United States Patent
Tadhani et al.

(10) Patent No.: US 10,161,664 B2
(45) Date of Patent: Dec. 25, 2018

(54) ICE VENDING MACHINE

(71) Applicant: Ice House America, LLC, Jacksonville Beach, FL (US)

(72) Inventors: Manoj Tadhani, Peachtree City, GA (US); Steven A. Weeks, Moultrie, GA (US)

(73) Assignee: Ice House America, LLC, Jacksonville Beach, FL (US)

( * ) Notice: Subject to any disclaimer, the term of this patent is extended or adjusted under 35 U.S.C. 154(b) by 530 days.

(21) Appl. No.: 14/841,895

(22) Filed: Sep. 1, 2015

(65) Prior Publication Data

US 2016/0069602 A1 Mar. 10, 2016

Related U.S. Application Data

(60) Provisional application No. 62/046,552, filed on Sep. 5, 2014.

(51) Int. Cl.

| | |
|---|---|
| ***F25C 5/20*** | (2018.01) |
| ***F25C 5/16*** | (2006.01) |
| ***G07F 11/58*** | (2006.01) |
| ***F25C 5/00*** | (2018.01) |

(52) U.S. Cl.

CPC ..... *F25C 5/16* (2013.01); *F25C 5/00* (2013.01); *G07F 11/58* (2013.01)

(58) Field of Classification Search

CPC ..... F25C 5/20; F25C 5/24; F25C 2300/00; F25C 2400/04

USPC ..... 141/134

See application file for complete search history.

(56) References Cited

U.S. PATENT DOCUMENTS

| | | | | |
|---|---|---|---|---|
| 3,151,668 | A | 10/1964 | Zimmermann | |
| 3,885,375 | A | 5/1975 | Solterbeck | |
| 4,158,426 | A | 6/1979 | Frohbieter | |
| 5,109,651 | A * | 5/1992 | Stuart | F25C 5/20 53/502 |
| 5,112,477 | A | 5/1992 | Hamlin | |
| 5,419,095 | A * | 5/1995 | Yohe | B65B 69/00 414/412 |
| 5,458,851 | A | 10/1995 | Schroeder et al. | |

(Continued)

OTHER PUBLICATIONS

Scotsman "Installation and User's Manual for Ice Maker-Dispenser" Scotsman Ice Systems; Apr. 2010.

(Continued)

*Primary Examiner* — Gloria R Weeks

(74) *Attorney, Agent, or Firm* — Brown & Michaels, PC

(57) ABSTRACT

An ice vending machine automatically provides ice to a customer based upon a request from the consumer for the ice. In some embodiments, the ice vending machine includes a transfer box to transfer ice from a horizontal auger to an inclined auger. In some embodiments, the inclined auger motor is mounted at the top of the inclined auger. The inclined auger motor may drive the inclined auger by way of a chain and sprockets or directly drive the inclined auger without a chain or sprockets. In some embodiments, a lip shelf is located at an edge of the holding vessel floor. In some embodiments, a rear wall is removable from the holding vessel. In some embodiments, the ice machine includes an awning, a top hat, or an ice maker canopy. In some embodiments, the ice vending machine includes an improved motor and chain layout.

7 Claims, 27 Drawing Sheets

(56) References Cited

U.S. PATENT DOCUMENTS 5,473,865 A * 12/1995 Tanaka ..... B65B 1/32 53/502
5,581,982 A * 12/1996 Schroeder ..... B65B 1/32 53/459
5,598,655 A 2/1997 McGarrah
5,655,386 A * 8/1997 Huang ..... F25C 5/002 62/320
5,822,955 A * 10/1998 Woosley ..... B65B 3/28 53/570
6,093,312 A 7/2000 Boulter
6,418,701 B1 * 7/2002 Navarro ..... B65B 7/2807 221/223
6,474,048 B1 11/2002 Metzger et al.
6,742,321 B2 * 6/2004 Gates ..... B65B 43/465 53/284.7
6,862,866 B2 * 3/2005 Jacobsen ..... B65B 7/02 53/133.4
6,904,946 B2 * 6/2005 James ..... B65B 43/123 141/313
6,932,124 B2 8/2005 Dalton et al.
7,104,291 B2 9/2006 Dalton et al.
7,426,812 B2 * 9/2008 Metzger ..... B65B 1/36 53/459
7,426,945 B2 9/2008 Dalton et al.
7,624,773 B2 * 12/2009 Maxwell ..... B65B 5/067 141/114
7,681,408 B2 3/2010 Hobson et al.
7,735,527 B2 6/2010 Dunn
7,806,152 B2 10/2010 Dalton et al.
7,810,301 B2 * 10/2010 Metzger ..... B65B 1/36 53/459
7,849,660 B2 * 12/2010 Metzger ..... B65B 1/36 53/58
7,958,918 B2 6/2011 Ladson
8,122,689 B2 2/2012 Pape
8,245,488 B2 8/2012 Dunn
8,256,195 B2 * 9/2012 Pape ..... B65B 1/06 141/83
8,528,302 B1 * 9/2013 Shaker ..... B65B 43/16 53/127
9,027,783 B2 * 5/2015 Houlton ..... B65D 1/26 220/609
9,114,902 B2 * 8/2015 Temple, Jr. ..... B65D 1/265
2006/0196152 A1 * 9/2006 Wild ..... B65B 59/02 53/459
2007/0240441 A1 * 10/2007 Hobson ..... B65B 43/36 62/233
2008/0283145 A1 * 11/2008 Maxwell ..... B65B 5/067 141/114
2009/0120039 A1 * 5/2009 Metzger ..... B65B 1/36 53/440
2010/0024363 A1 * 2/2010 Pape ..... B65B 9/093 53/459
2010/0313524 A1 * 12/2010 Pape ..... B65B 9/093 53/459
2010/0319806 A1 12/2010 Dalton et al.
2011/0041467 A1 * 2/2011 Pape ..... B65B 1/06 53/558
2011/0078982 A1 * 4/2011 Frazier ..... B65B 51/065 53/419
2011/0308203 A1 * 12/2011 Strating ..... B65B 43/44 53/469
2012/0247066 A1 10/2012 Dunn et al.
2013/0092703 A1 4/2013 Venet, III et al.
2014/0102582 A1 4/2014 Venet, III et al.
2014/0102583 A1 4/2014 Venet, III et al.
2014/0137513 A1 * 5/2014 Shaker ..... B65B 43/16 53/384.1
2016/0362246 A1 * 12/2016 Garcin ..... A47J 31/0673

OTHER PUBLICATIONS

"Kooler Ice IM2500", retrieved from http://www.cowtownicevending.com/webadmin/uploads/kooler_ice_im2500_brochure_-_web.pdf; 2012.
"Iceborn vending machine", retreived from http://www.google.com/urlsa=i&rct=j&q=&esrc=s&source=images&cd=&docid=XNFBa7i4eOTc5M&tbnid=gLi1mehndueqoM&ved=0CAUQjRw&u1=http%3A%2F%2Fwww.icehouseamerica.com%2F&ei=41jzU7zrCOWj8AHGvICAAQ&bvm=bv_73231344,d.cGU&psig=AFQjCNEFz8_ounoC0aBDdsdVIUG372iZaQ&ust=1408543320188080, at least as early as Aug. 19, 2014.
"Just Ice vending machine", retrieved from http://www.jandjice.com/images/Belleview-Icehouse-001.jpg, at least as aarly as Aug. 19, 2014.
"Polar Station vending machine", retrieved from http://www.polariceandwater.com/P014ric3/wp-content/uploads/2012/09/Polar-Ice-vending-3.jpg, Sep. 2012.
"Polar Station Night vending machine", retrieved from http://www.polariceandwater.com/P014ric3/wp-content/uploads/2011/10/night-300x239.jpg, Oct. 2011.
"The Ice Bucket vending machine", retrieved from http://www.theicebucket.com/photos/upload/12%27%20machine%20water%20vending/Wooden_Nickel_&_Ice_House_March_2010_028_(2).jpg, Mar. 2010.

* cited by examiner

ICE VENDING MACHINE

BACKGROUND OF THE INVENTION

Field of the Invention

The invention pertains to the field of vending machines. More particularly, the invention pertains to ice vending machines.

Description of Related Art

Ice vending machines that dispense ice automatically on demand to a customer are known in the art. U.S. Pat. No. 6,474,048, entitled "Automatic ice producing, bagging, and dispensing machine" and issued Nov. 5, 2002 to Metzger et al., U.S. Pat. No. 6,932,124, entitled "Automated Ice Bagging Apparatus and Methods" and issued Aug. 23, 2005 to Dalton et al., U.S. Pat. No. 7,104,291, entitled "Automated Ice Bagging Apparatus and Methods" and issued Sep. 12, 2006 to Dalton et al., U.S. Pat. No. 7,426,945, entitled "Automated Ice Bagging Apparatus and Methods" and issued Sep. 23, 2008 to Dalton et al., U.S. Pat. No. 7,735,527, entitled "Automated Ice Delivery Apparatus and Methods" and issued Jun. 15, 2010 to Dunn, U.S. Pat. No. 7,806,152, entitled "Automated Ice Bagging Apparatus and Methods" and issued Oct. 5, 2010 to Dalton et al., U.S. Pat. No. 8,122,689, entitled "Method and Apparatus for Producing, Bagging and Dispensing ice" and issued Feb. 28, 2012 to Pape, U.S. Pat. No. 8,245,488, entitled "Automated Ice Delivery Apparatus and Methods" and issued Aug. 21, 2012 to Dunn, U.S. Patent App. Pub. No. 2010/0319806, entitled "Automated Ice Bagging Apparatus and Methods" by Dalton et al. and published Dec. 23, 2010, and U.S. Patent App. Pub. No. 2012/0247066, entitled "Ice Bagging Apparatus and Methods" by Dunn et al. and published Oct. 4, 2012, each disclose a vending machine that dispenses ice on demand to a customer.

The above-mentioned references are hereby incorporated by reference herein.

SUMMARY OF THE INVENTION

An ice vending machine automatically provides ice to a customer based upon a request from the consumer for the ice. In some embodiments, the ice vending machine includes a transfer box to transfer ice from a horizontal auger to an inclined auger. In some embodiments, the inclined auger motor is mounted at the top of the inclined auger. In some embodiments, the inclined auger motor drives the inclined auger by way of a chain and sprockets. In other embodiments, the inclined auger motor directly drives the inclined auger without a chain or sprockets. In some embodiments, a lip shelf is located at an edge of the holding vessel floor. In some embodiments, a rear wall is removable from the holding vessel. In some embodiments, the ice vending machine includes a vendor front with curved upper and lower portions. In some embodiments, the ice machine includes an awning, a top hat, or an ice maker canopy. In some embodiments, the ice vending machine includes an improved motor and chain layout.

DETAILED DESCRIPTION OF THE INVENTION

Figure 1:
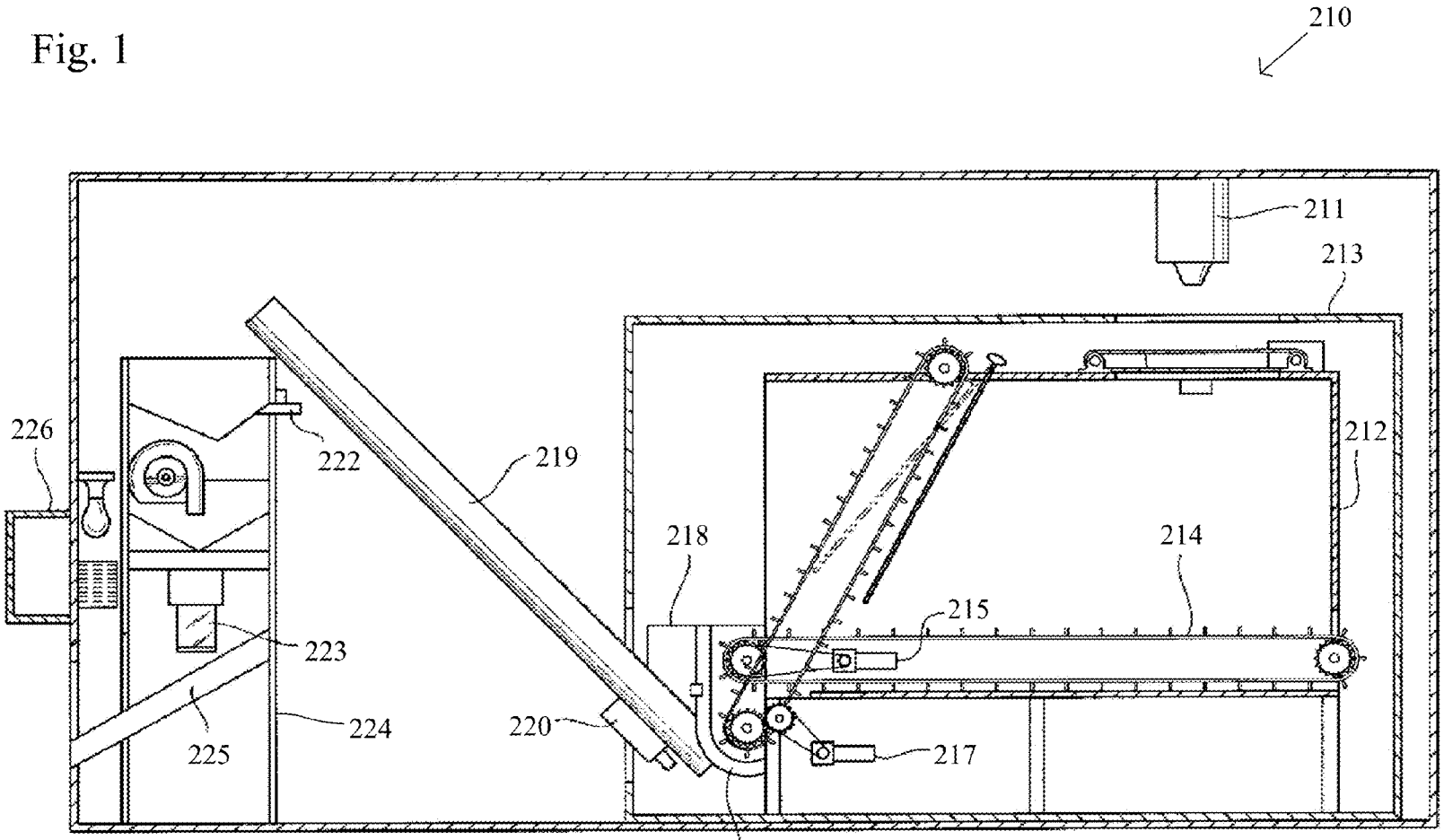
PRIOR ART Fig. 1
FIG. 1 shows a schematic side view of a prior art ice vending machine.

FIG. 1 shows the general layout of a type of prior art ice vending machine 210, to which certain embodiments of the present invention apply. The ice maker 211 produces pieces of ice based on demand, and the pieces of ice fall into the holding vessel 212 of the insulation chamber 213 of the ice vending machine 210. The ice maker 211 is located outside of the insulation chamber 213 to minimize the amount of space required to be insulated, and to inhibit freezing of the ice maker components or the water being used to make the ice. A conveyor 214 driven by a conveyor motor 215 moves ice from the floor of the holding vessel 212 on demand horizontally to a horizontal auger 216 at the edge of the holding vessel 212. The horizontal auger 216, driven by a horizontal auger motor 217, transports the ice in a horizontal direction perpendicular to the direction of the conveyor 214 to bring the ice to a transfer box 218 at the base of an inclined auger 219.

The inclined auger 219, driven by an inclined auger motor 220, transports the ice to the bagging and vending area. The ice drops from the top of the inclined auger 219 onto a weighing device 222 until enough ice to fill a bag 223 has been detected. The closing device 224 then closes the bag 223 and the bag 223 drops to a vending slide 225, which transports the bag 223 to a vending window, where it is retrieved by the customer. The whole operation is controlled electronically and driven based on demand from a customer through a vending interface 226 at the front of the ice vending machine 220.

Transfer Box

Traditionally, the lower end of the pipe for the inclined auger 219 is cut to an oval profile to mount on a vertical face of the transfer box 218 in order for the inclined auger 219 to extend at an inclined angle. The oval profile must be exact to correspond to the desired angle. The profile of the transfer box 218 then has an angled wall parallel to the inclined auger 219 extending from the bottom of the vertical face, then an angled wall perpendicular to the inclined auger 219, then a vertical wall extending upward, and finally a wall angling outward.

Figure 2:
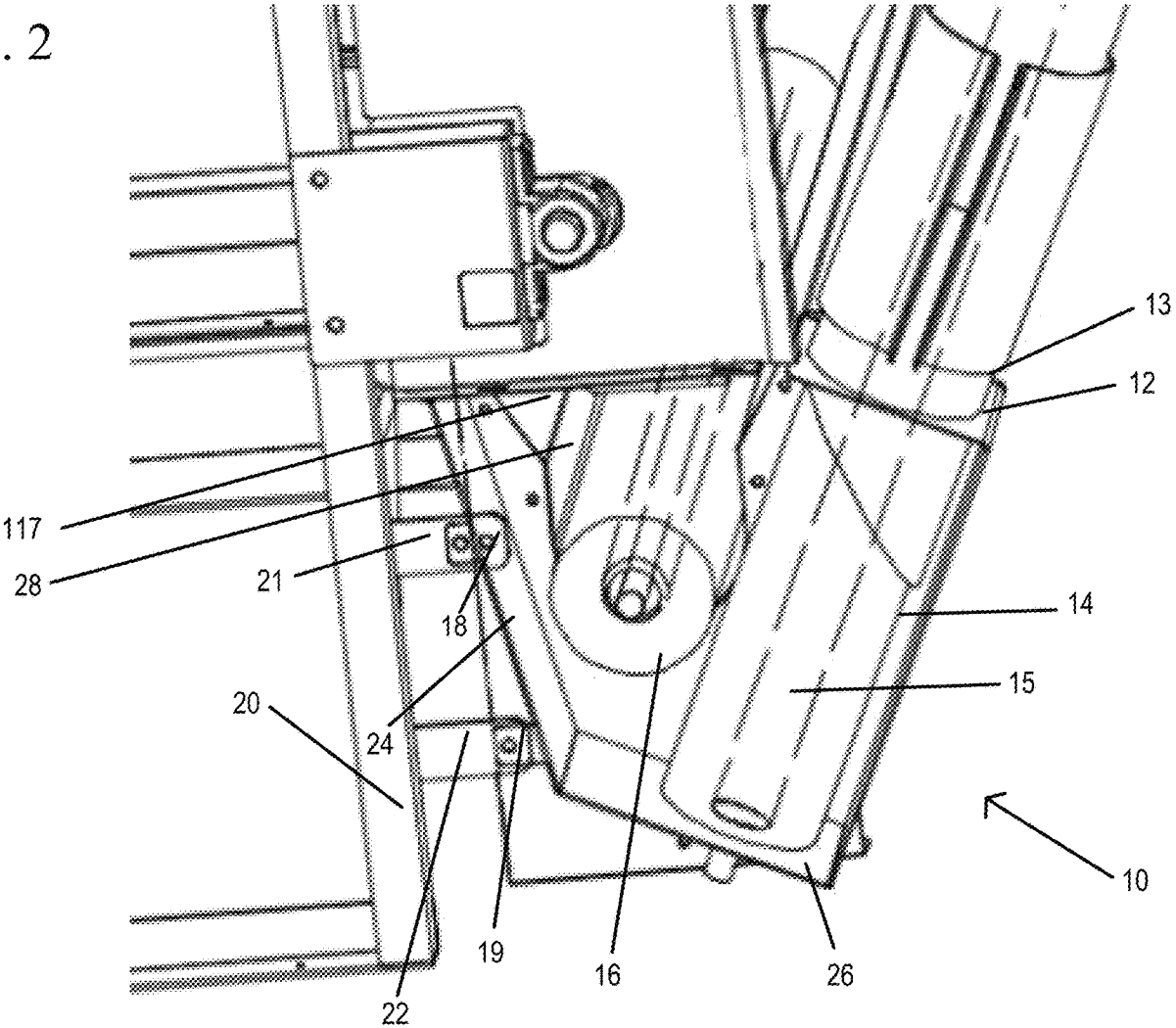
FIG. 2 shows an elevated perspective side view of a transfer box of an ice vending machine in an embodiment of the present invention.
Figure 3:
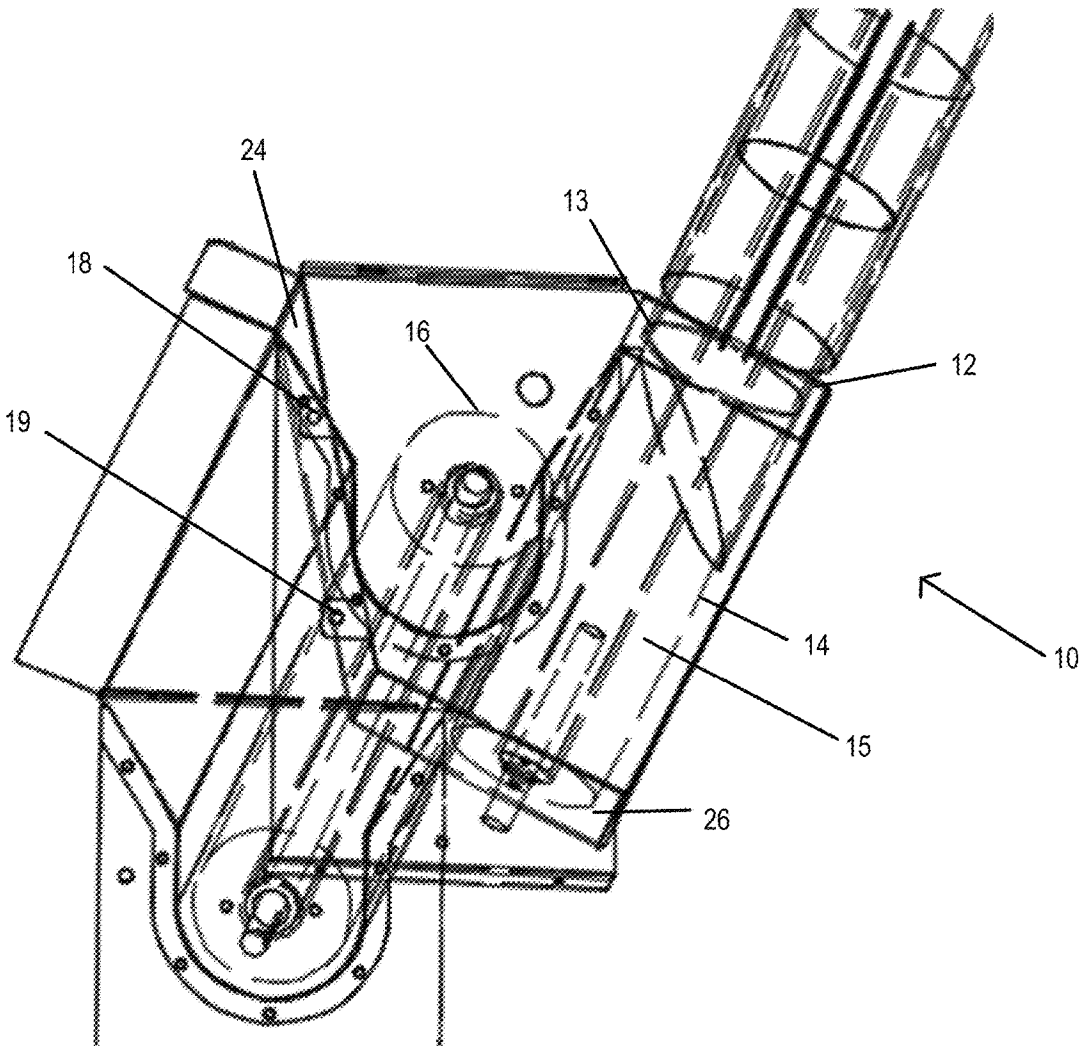
FIG. 3 shows another side view of the transfer box of FIG. 2.
Figure 4:
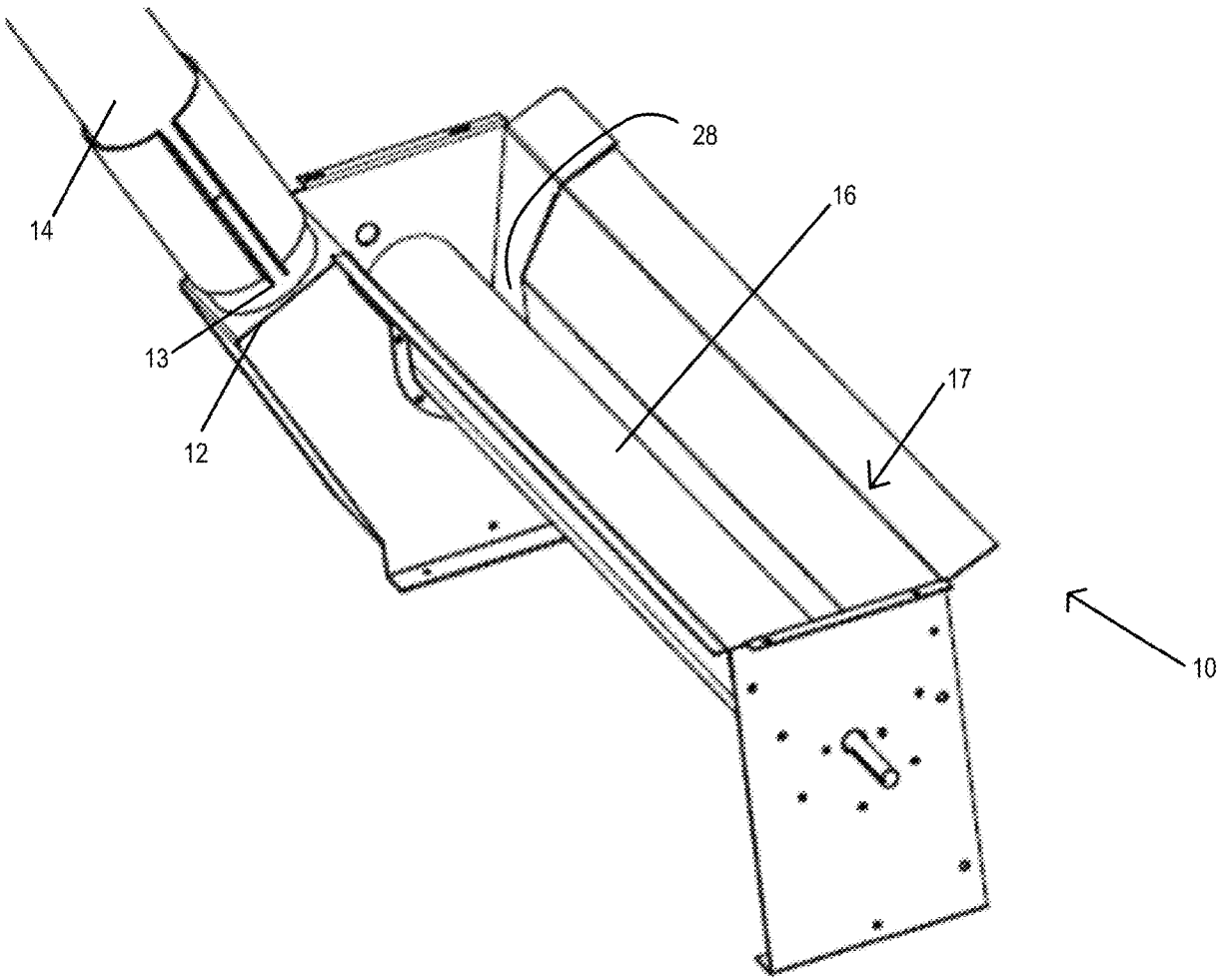
FIG. 4 shows an elevated perspective side view of the opposite side of the transfer box of FIG. 2.

Referring to FIG. 2, FIG. 3, and FIG. 4, an improved transfer box 10 has an angled face 12 with a circular opening 13 that receives the inclined auger pipe 14 at a perpendicular to the angled face 12. The inclined auger pipe 14 does not need to be cut at an angle in order to mount to the transfer box 10. The specially profiled transfer box 10 facilitates the mounting of the inclined auger pipe 14 at any incline angle within a predetermined range without cutting the end of pipe at that incline angle, because the transfer box is rotatable about the axis of the horizontal auger 16 to provide the mounting surface 12 with the circular opening 13 perpendicular to the end of the inclined auger pipe 14 within the predetermined incline angle range. The transfer box 10 includes two brackets 18, 19 to mount to two brackets 21, 22 on a support 20 to maintain the transfer box 10 in position to receive the inclined auger pipe 14 at the predetermined incline angle.

The rear profile of the transfer box 10 includes a straight inclined wall 24 that allows the ice to flow smoothly down into the transfer box, and avoid clumping and ice stuck in the middle. A straight bottom wall 26 meets the straight inclined wall 24, is substantially parallel to the angled face 12, and receives the bottom end of the inclined auger 15. As best shown in FIG. 2 and FIG. 4, the opening 28 between the transfer box 10 and the horizontal auger bin 17 is also re-designed to avoid clumping or stuck ice, with the upper parts of both walls 117 angling toward each other to funnel the ice toward the inclined auger 15.

Top Mount Inclined Auger Motor

A conventional design for ice vending machines mounts the inclined auger motor 220 for the inclined auger 219 under the transfer box 218 close to the floor. This arrangement, however, limits the design options for the transfer box 218, makes it difficult to access the inclined auger motor 220 for maintenance or repair, and requires the inclined auger, and hence the horizontal auger 216 and holding vessel 212 to be raised higher above the floor of the ice vending machine 210 than would otherwise be necessary.

Figure 6:
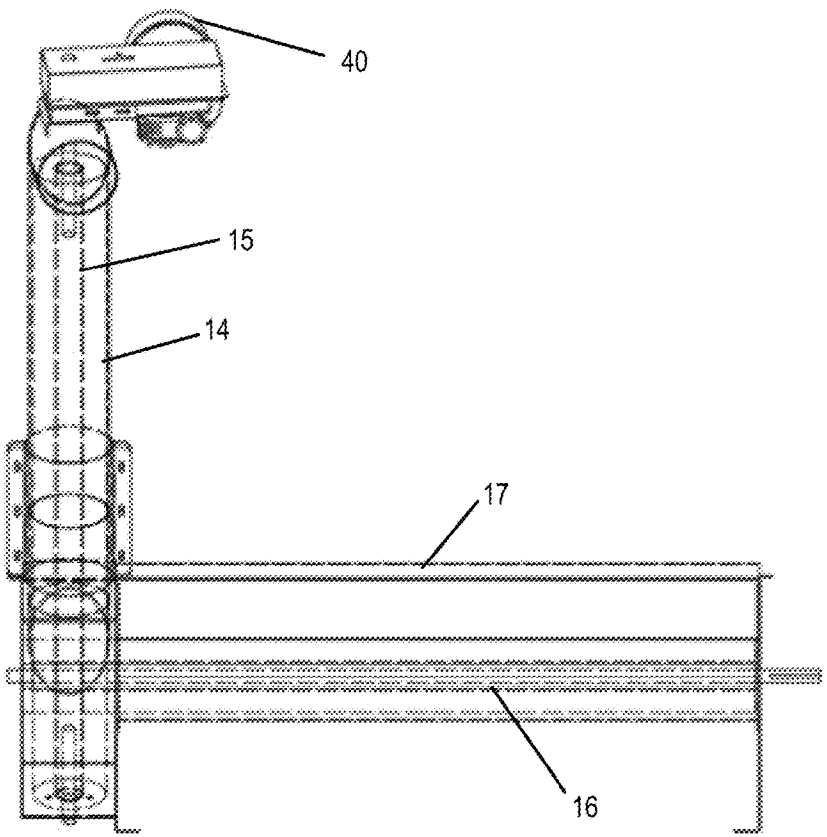
FIG. 6 shows a side view of the assembly of FIG. 5.
Figure 5:
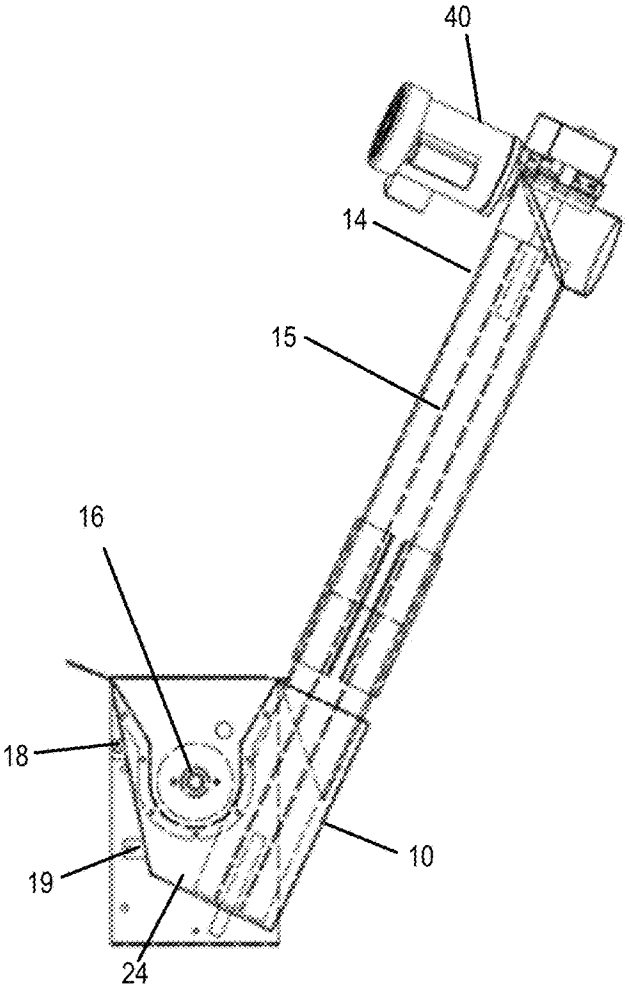
FIG. 5 shows an end view of the transfer box of FIG. 2, a horizontal auger, an inclined auger, and a chain drive auger motor.

Referring to FIG. 5 and FIG. 6, a preferred layout of a horizontal auger 16, a transfer box 10, an inclined auger 15, and an inclined auger motor 40 is shown. The inclined auger motor 40 is mounted at the top of the inclined auger 15. Although preferred dimensions in inches and a preferred incline angle are shown in FIG. 5 and FIG. 6, these dimensions and this incline angle are not intended to be limiting. Other dimensions and incline angle within a range of dimensions and incline angles may be used within the spirit of the present invention, depending on other design considerations for the ice vending machine, including, but not limited to, a predetermined ice output capacity of the ice vending machine and the overall predetermined dimensions for the ice vending machine. A conventional incline angle is about 45 degrees. In some embodiments, the incline angle is in the range of about 60 to about 75 degrees. In some embodiments, the incline angle is about 65 degrees.

Figure 7:
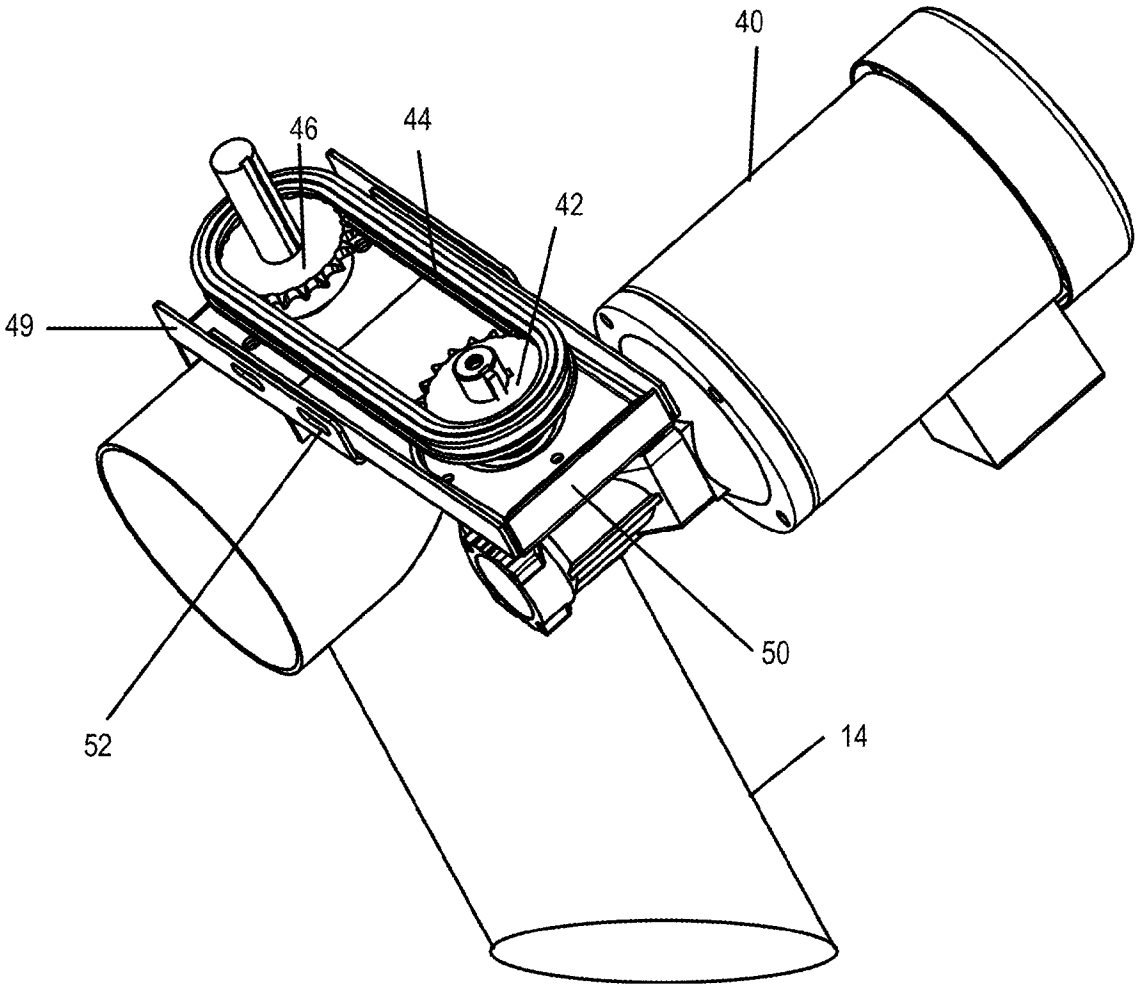
FIG. 7 shows a perspective view of a chain drive auger motor at the top of an inclined auger of an ice vending machine in an embodiment of the present invention.
Figure 8:
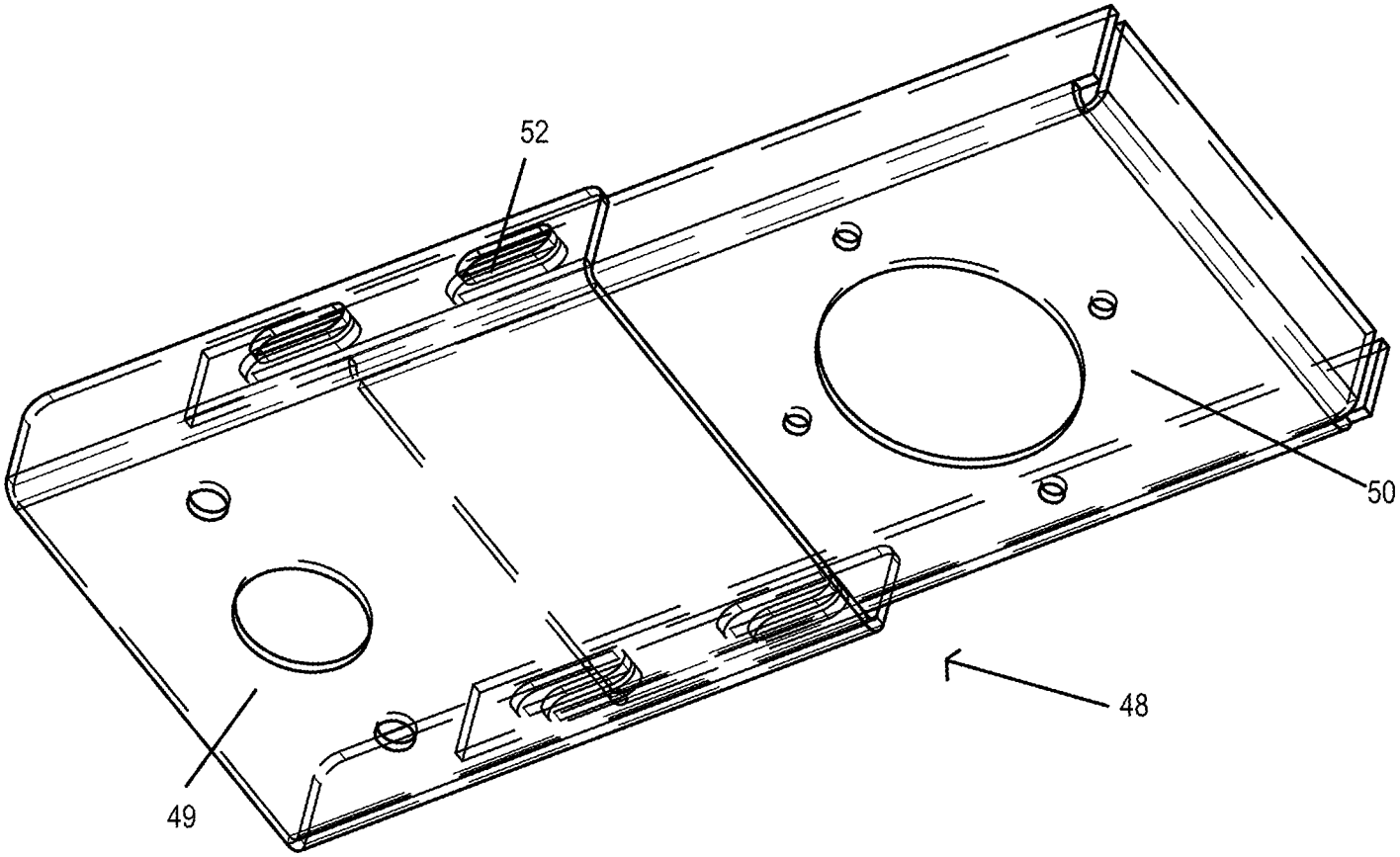
FIG. 8 shows a perspective bottom view of the bracket for the chain drive auger motor of FIG. 7.

In some embodiments, the inclined auger motor 40 drives the inclined auger 15 by way of a chain and sprockets, as shown in FIG. 7. The inclined auger motor 40 is mounted on brackets on the top of the inclined auger pipe 14 at an offset, which provides improved access to the inclined auger motor 40 and improved layout flexibility for other elements of the ice vending machine. The inclined auger motor 40 is preferably an electric motor. The inclined auger motor 40 drives a first sprocket 42, which drives a chain 44, which drives a second sprocket 46 to turn the inclined auger 15. The use of a chain 44 and sprockets 42, 46 allows the inclined auger motor 40 to be positioned at a much more accessible orientation. Referring to FIG. 7 and FIG. 8, a specially-designed sliding bracket 48 allows tightening of the chain 44 if it becomes loose. The shaft associated with one sprocket 46 passes through a first half 49 of the bracket 48, and the shaft associated with the other sprocket 46 passes through a second half 50 of the bracket 48. The two halves 49, 50 of the bracket 48 are slidable with respect to each other to adjust the distance between the two sprockets 42, 46, thereby tightening or loosening the chain 44. When the bracket 48 is adjusted to the bracket position for a predetermined chain tightness, a fastener tightened in a slot 52 through the two halves of the bracket 48 maintains the bracket 48 at that bracket position.

Figure 9:
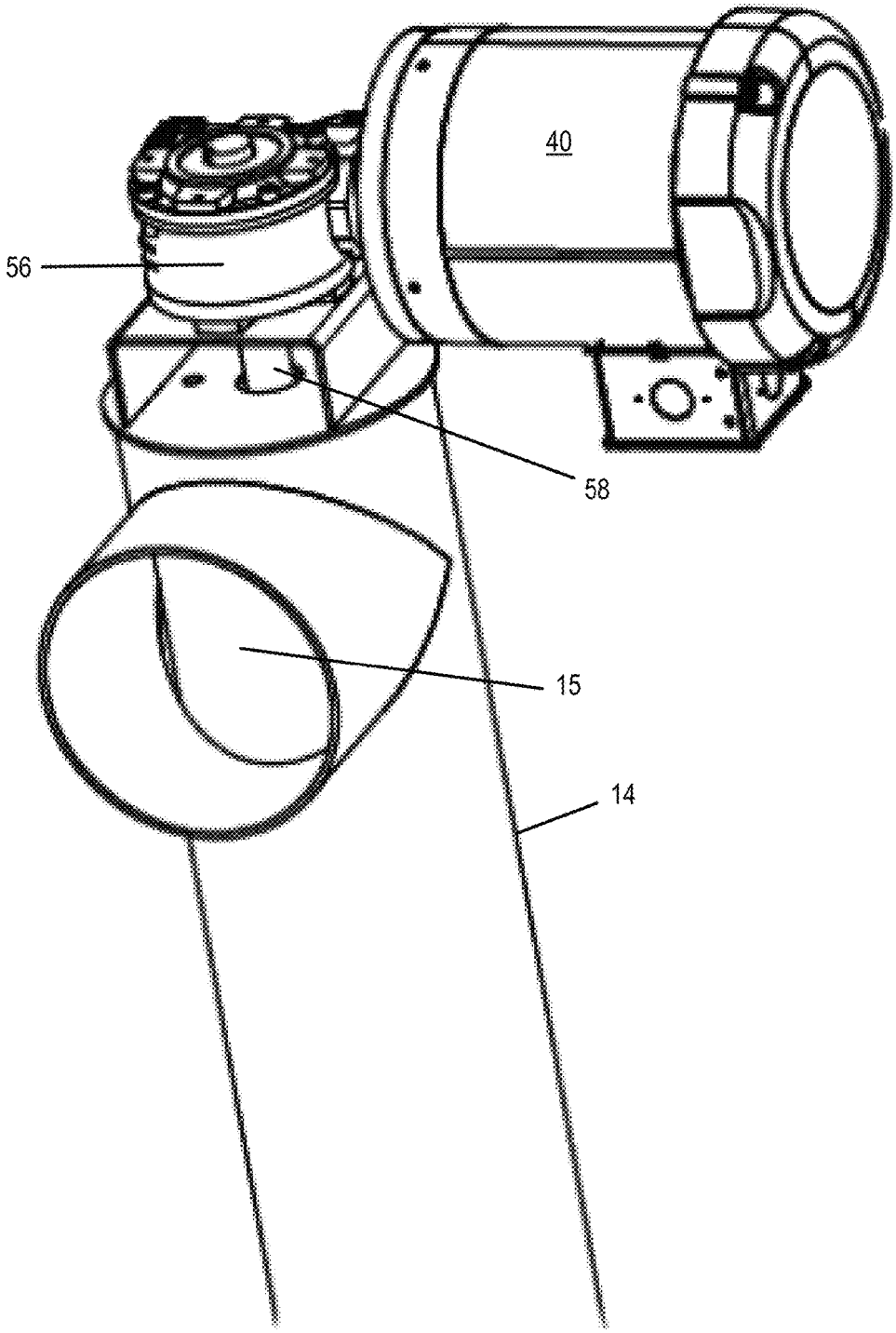
FIG. 9 shows a view of a direct drive auger motor at the top of an inclined auger of an ice vending machine in an embodiment of the present invention.

In other embodiments, the inclined auger motor 40 directly drives the inclined auger 15, as shown in FIG. 9. The inclined auger motor 40 to drive the inclined auger 15 is mounted directly on the top of the inclined auger pipe 14 without the use of chains and sprockets. The inclined auger motor is preferably an electric motor. The gearbox 56 is mounted directly on the inclined auger shaft 58, although the inclined auger motor 40 is preferably offset from the shaft 58 slightly, as shown in FIG. 9. This design also provides the flexibility to position the inclined auger motor 40 at a desired orientation for easy removal.

Lip Shelf

Most conventional ice vending machines, especially those using crushed ice, do not have any shelf at the edge of the holding vessel floor near the horizontal auger 216. In these machines there is nothing to prevent an avalanche of ice from the holding vessel 212 from cascading into the horizontal auger. Conventional ice vending machines that do have a shelf at the edge of the holding vessel floor just have a flat plate.

Figure 10:
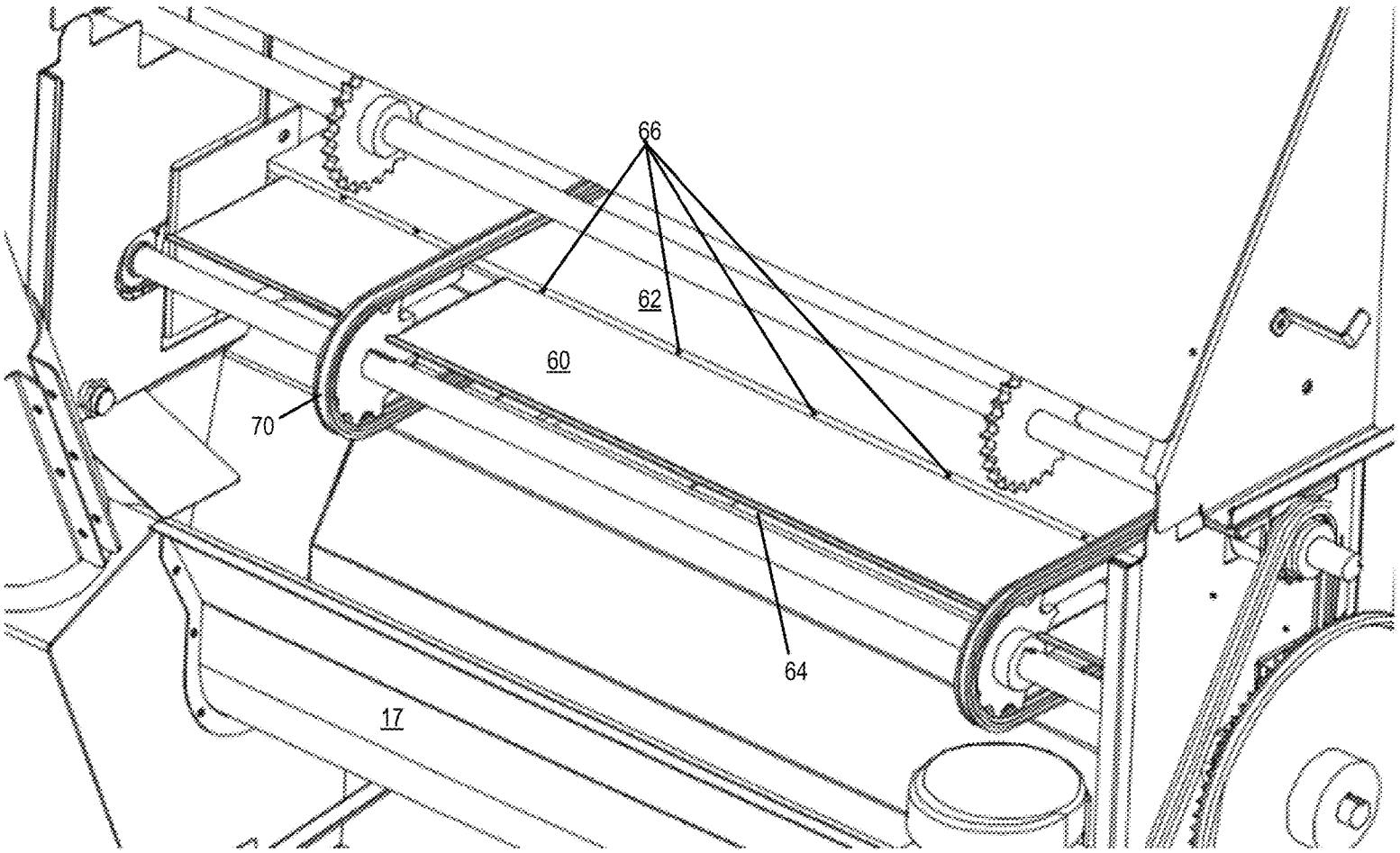
FIG. 10 shows a perspective view of a lip shelf in an ice vending machine in an embodiment of the present invention.
Figure 11:
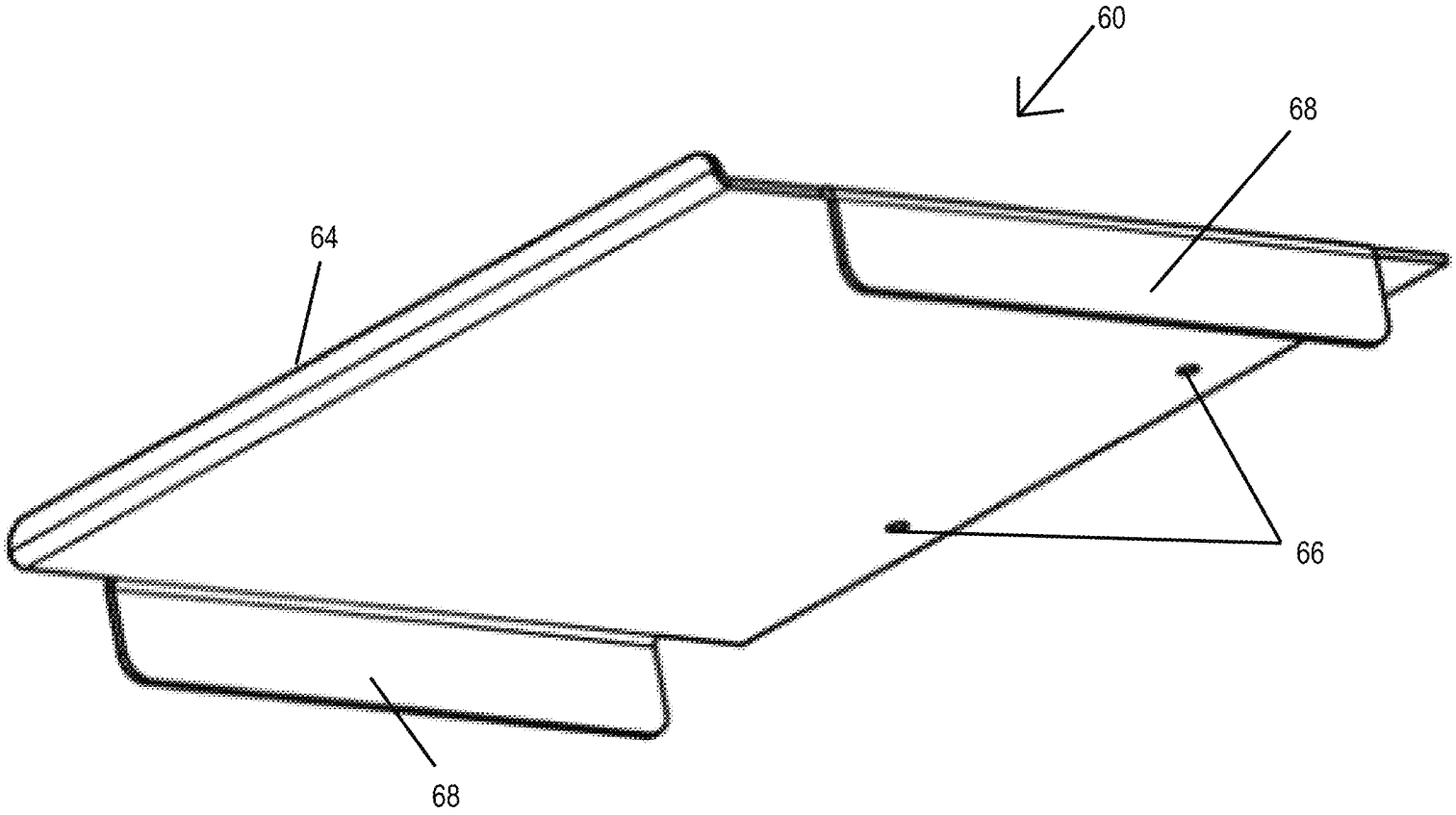
FIG. 11 shows another perspective view of the lip shelf of FIG. 10.

Referring to FIG. 10 and FIG. 11, a specially ribbed lip shelf 60 prevents the avalanche of ice from the floor 62 of the holding vessel into the horizontal auger bin 17. The lip shelf 60 is designed such that, it not only limits the avalanche of ice, but also remains stiff enough under the load the ice, with the help of a reversed lip 64. In some embodiments, the lip shelf 60 is made of stainless steel. The lip shelf 60 is attached to the edge of the holding vessel floor 62 along one edge of the lip shelf 60 by fasteners through holes 66 along the edge of the lip shelf. The lip shelf 60 extends upward with a reversed lip 64 along the edge opposite the fastened end. The lip shelf 60 extends downward along the other two edges, with the downward flanges 68 being supported on a crossbar member (not visible in FIG. 10) to support the weight of the ice on the lip shelf 60. The lip 64 is designed not to contact the conventional drag bars 270 (not shown in FIG. 10) from the horizontal conveyor 70 as they pass by the lip shelf 60.

Removable Rear Wall

All large conventional ice vending machines with ice bins as holding vessels 212 have the rear bin wall always welded to the side bin walls. This is primarily to assure that no threaded surface with gaps, such as for a screw, bolt, or nut, comes into contact with ice or water in order to build up mold in the holding vessel enclosure.

Figure 12:
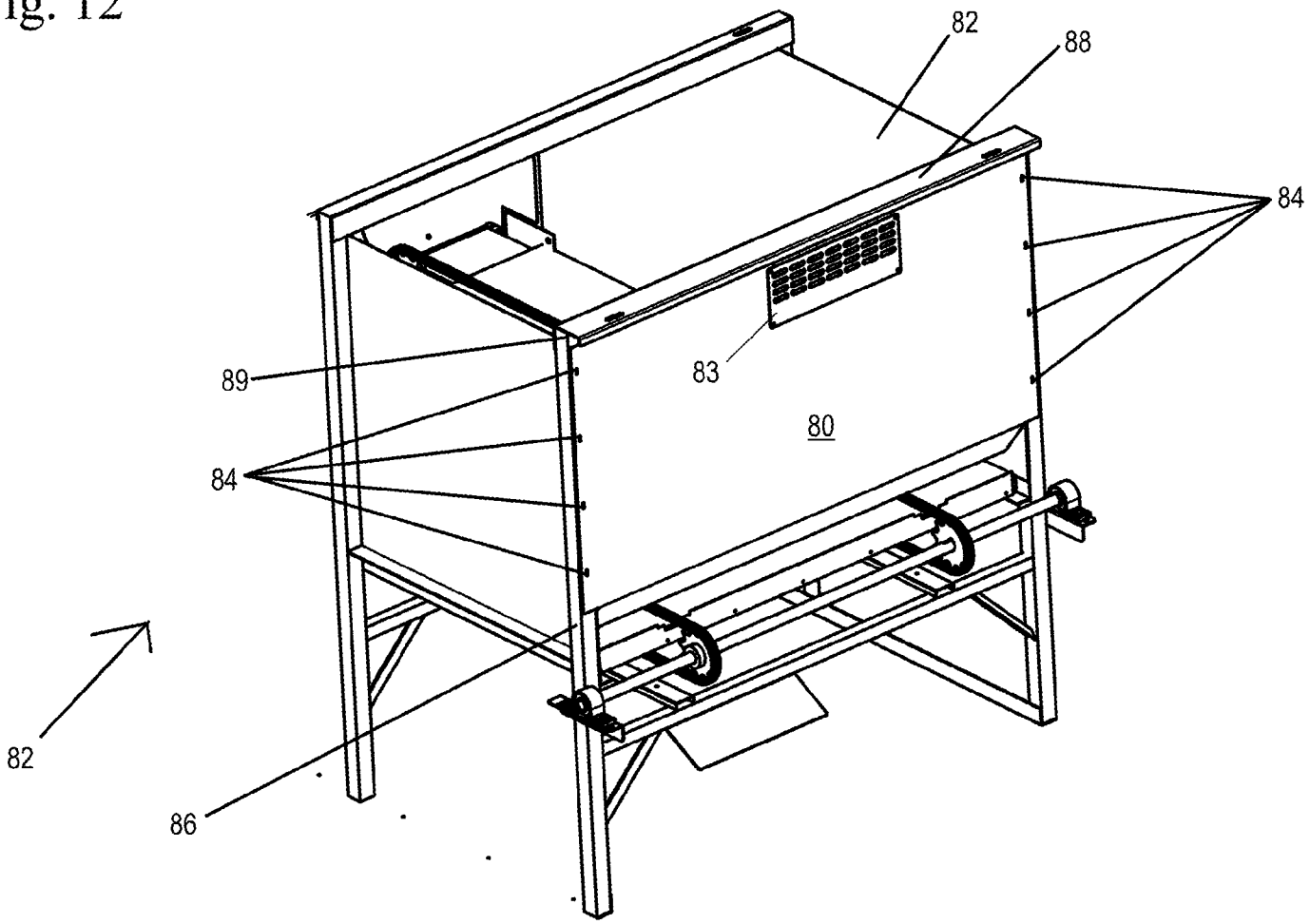
FIG. 12 shows a holding vessel of an ice vending machine with a removable rear wall in an embodiment of the present invention.
Figure 13:
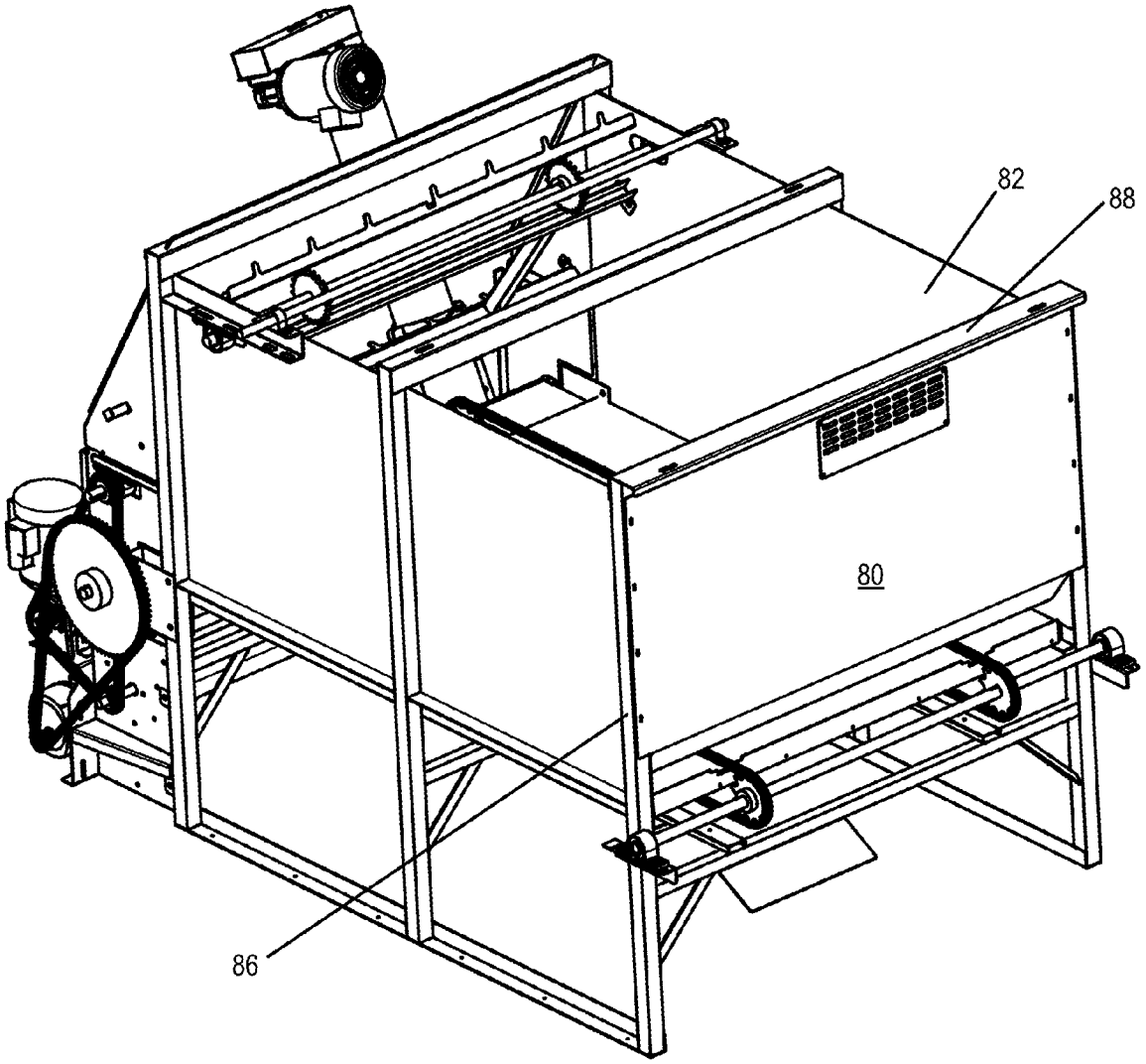
FIG. 13 shows the holding vessel of FIG. 12 with the rear wall removed.

Referring to FIG. 12 and FIG. 13, the removable rear wall 80 of the holding vessel 82 is attached by fasteners through holes 84 along the two opposing side edges of the rear wall 80, but these fasteners do not contact ice or water in the holding vessel 82. Instead, flanges 86 at the rear edges of the side walls extend to the sides and receive the fasteners, and the rear wall 80 is wider than the outer width of the side walls. The fasteners extend through the rear wall and the flanges such that the fasteners are located completely outside the holding vessel. A flange 88 extending back from the top of the holding vessel 82 forms a seal with the top edge of the rear wall 80. With the removable rear wall 80, it is much easier to service the ice vending machine under a catastrophic event, including, but not limited to, providing access to the ice maker from inside the holding vessel 82.

In some embodiments, the removable rear wall 80 is not fastened along the top edge. Instead, a gap 89 is provided above the top edge of the rear wall 80. In some embodiments, the width of the gap 89 is in the range of about 1 to about 3 inches. In some embodiments, the width of the gap 89 is about 2 inches. With the rear wall 80 attached to the holding vessel 82, the gap 89 allows visual access to at least a portion of the interior space of the holding vessel 82 while minimizing physical access to the interior space.

The perforated access/observation panel 83 shown in middle-top end of the rear wall 80 is part of the rear wall, but removable. The purpose of this panel is to provide visual access inside the bin. In addition, this panel can be removed (without removing the rear wall) to provide physical access to "Bin full signal bracket & Sensor" mounted on the inside of the rear bin.

Vendor Front

Figure 14A:
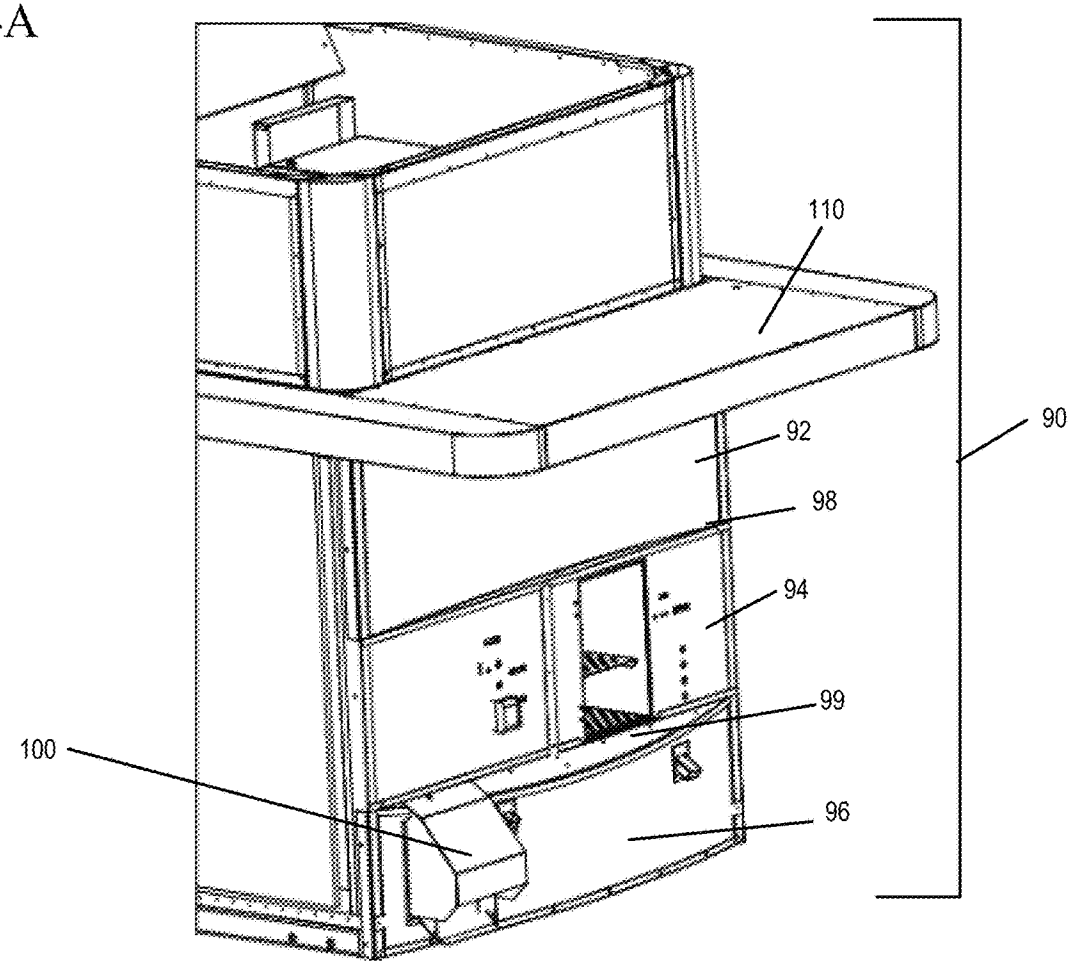
FIG. 14A shows a perspective view of a vendor front of an ice vending machine in an embodiment of the present invention.
Figure 14B:
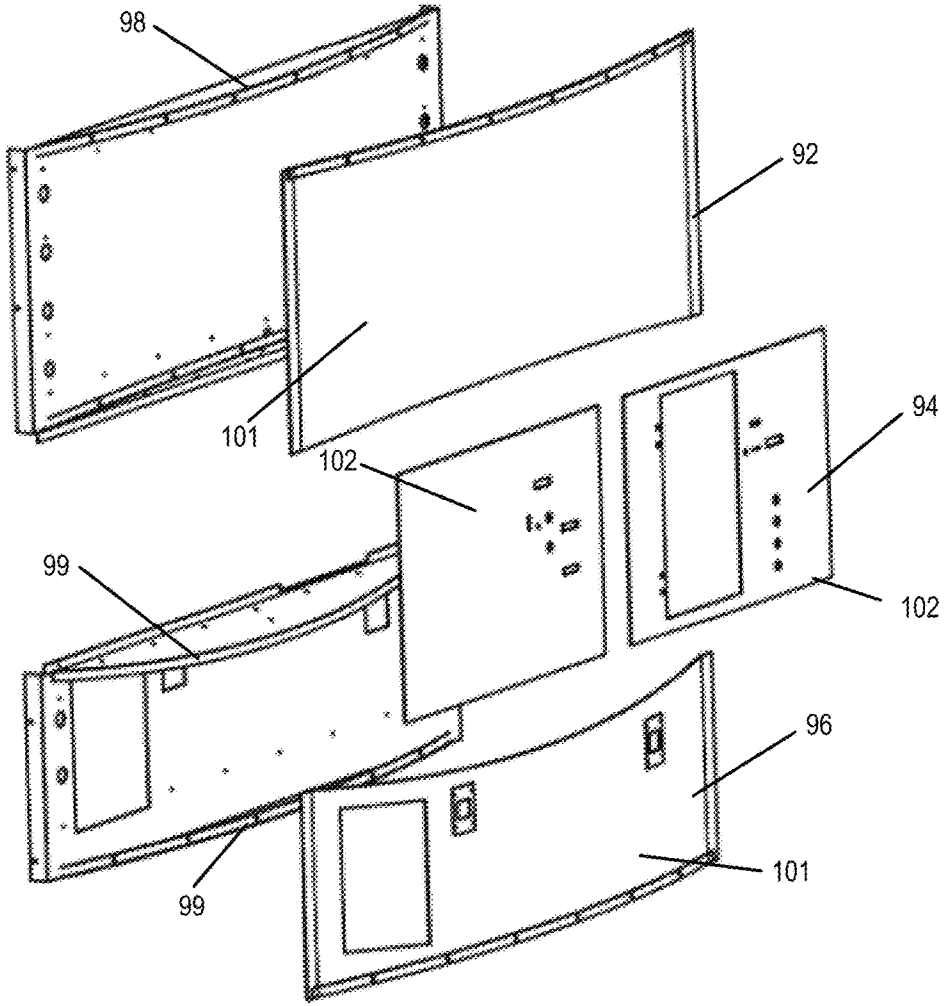
FIG. 14B shows a partially exploded view of the vendor front of FIG. 14A.
Figure 15:
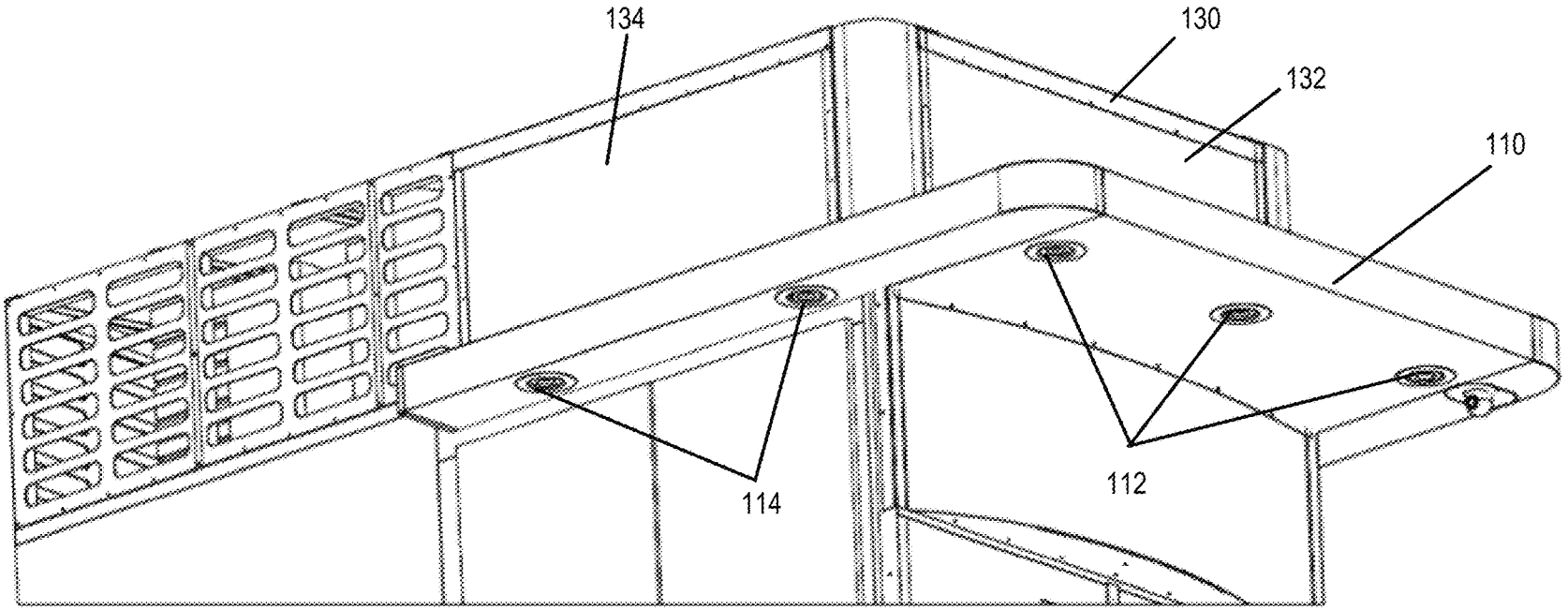
FIG. 15 shows a perspective view of an awning and a top hat of an ice vending machine in an embodiment of the present invention.
Figure 16:
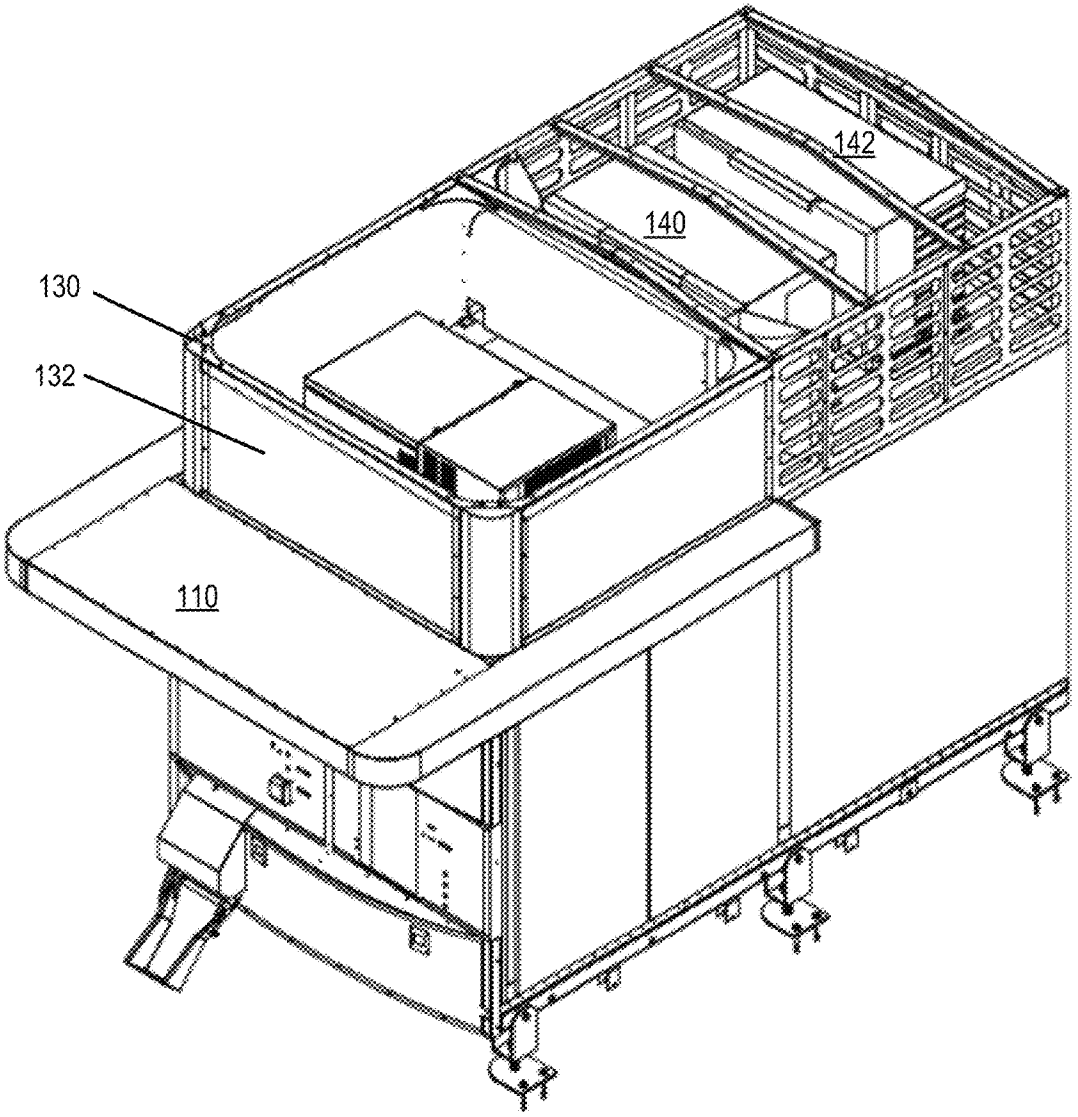
FIG. 16 shows an elevated perspective view of the ice vending machine of FIG. 15.
Figure 17:
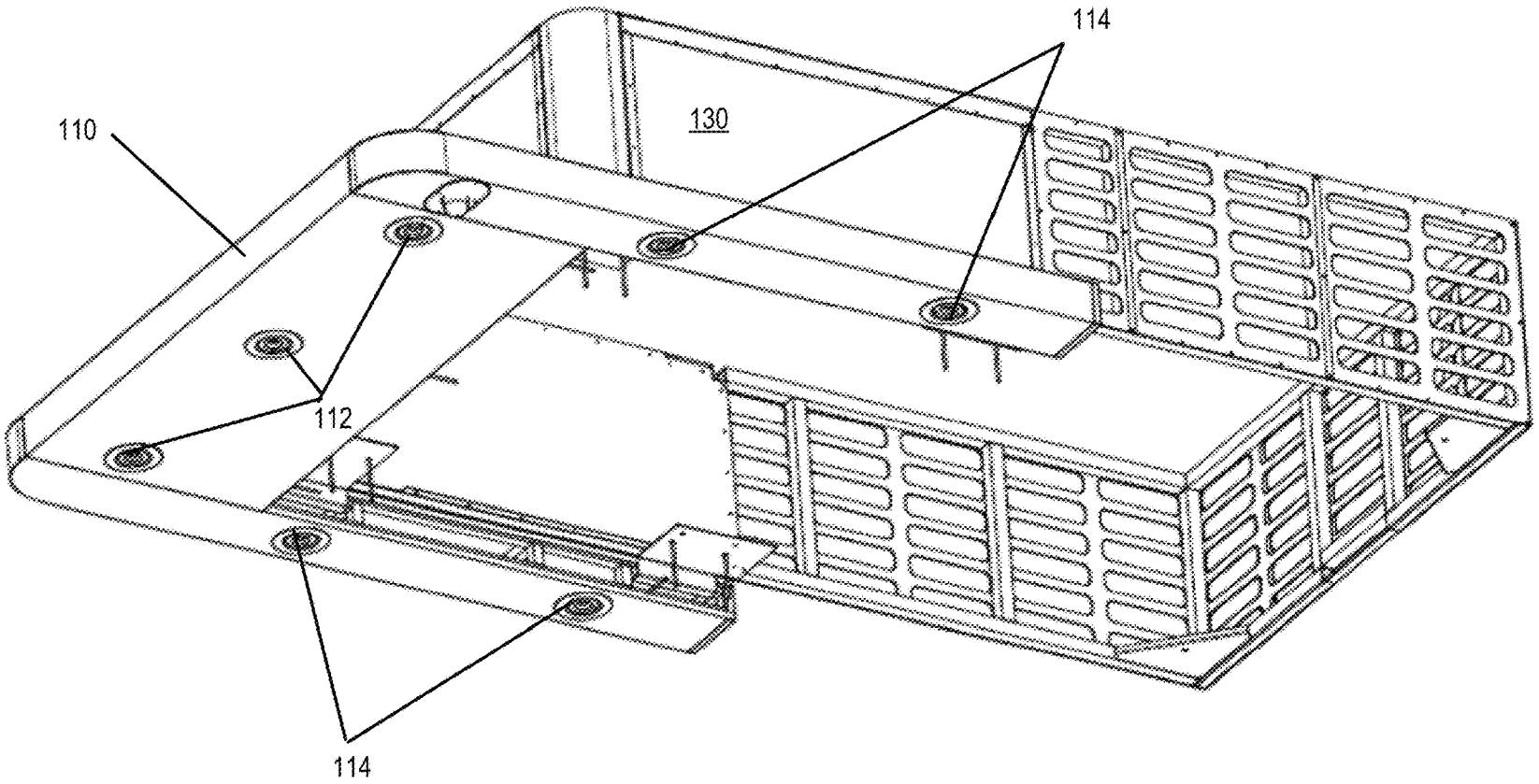
FIG. 17 shows a bottom perspective view of the awning and top hat of FIG. 15.
Figure 18:
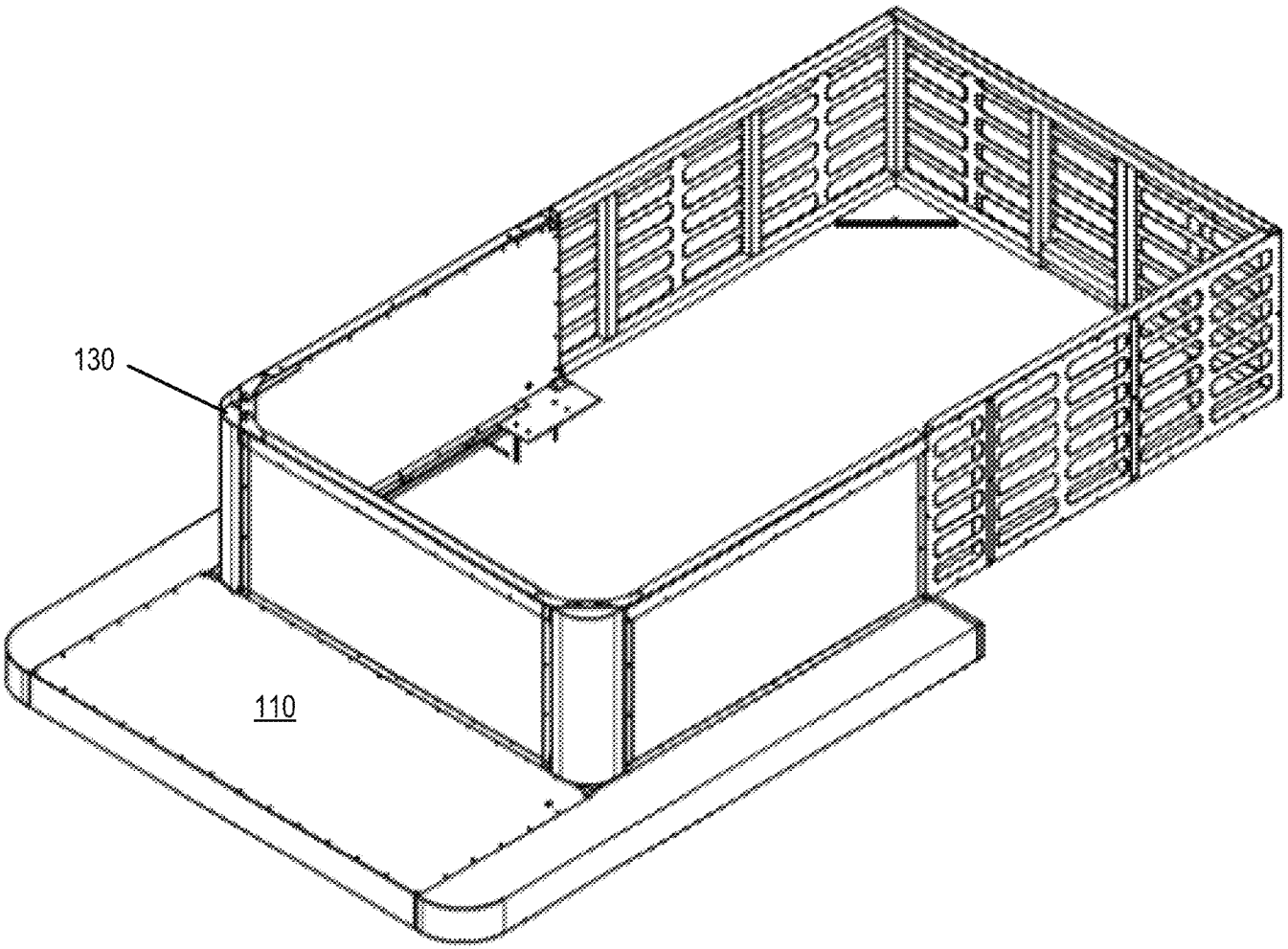
FIG. 18 shows a top perspective view of the awning and top hat of FIG. 15.

Referring to FIG. 14A and FIG. 14B, the vendor front 90 of an ice vending machine is different compared to any other ice vending machine in the marketplace today. This vendor front 90 incorporates, primarily, three sections 92, 94, 96 using backlit illuminated panels.

The panels for the top section 92 and the bottom section 96 can be installed with an outward (convex) curved profile, while the panel for the middle section 94 can be installed flat, making a unique appearance. Both top and bottom panels have light-emitting diode (LED) backlights to illuminate the graphics on the curved panel. The vending chute 100 is located in the bottom section 96. All of these panels are secured by profiled trim 98, 99. The trim 98, 99 is preferably made of stainless steel.

The middle section 94 contains the customer interface, where the customer provides payment and selects the product to be vended.

The vendor front is preferably assembled by the following steps. Metal plates with curved trim 98, 99 are fastened to the outside front wall of the ice vending machine. Top and bottom graphics panels 101 are mounted on the metal panel trim 98, 99. The middle two graphics panels 102 are mounted side-by-side directly on the front wall of the ice vending machine. Finally, additional outside trim goes on top of the graphics panels, sandwiching each graphics panel in between metal trims.

Tier Look Awning and Top Hat

Conventional ice vending machines use a sloped metal frame with fabric as an awning to cover the customer interface area and the customer to protect them from rain and sun.

Referring to FIG. 15 through FIG. 23, the awning 110 is shaped as a flat canopy with an aluminum frame structure inside and a metal coil/panel wrap outside. The awning 110 provides shelter for the customer standing at the vendor front. Inbuilt LED lights 112 mounted in the awning 110 face downward to provide additional light to the vendor front area. The awning 110 also extends partly around the sides of the ice vending machine with additional LED lights 114 lighting the sides below the awning 110.

Referring to FIG. 20 through FIG. 23, the complete awning structure is predominantly held by double-lipped brackets 115, 116 at the front corners and the rear sides, respectively. Square aluminum tubes, preferably 1.5"×1.5", provide the backbone structural support 118 for the awning 110. The corner brackets 115 each include a flat surface 120 and J-shaped channels 121, 122 along two adjacent edges of the flat surface 120 to receive and hold the square tubes at the corners of the awning. The flat surface 120 also includes openings 123 to receive fasteners to attach the corner bracket 115 to the main housing of the ice vending machine. The edge brackets 116 each include a flat surface 126 and a J-shaped channel 127 along one edge of the flat surface 126 to receive and hold the square tubes at the inside back edges of the awning. The flat surface 126 also includes openings 128 to receive fasteners to attach the edge bracket 116 to the main housing of the ice vending machine.

Figure 19:
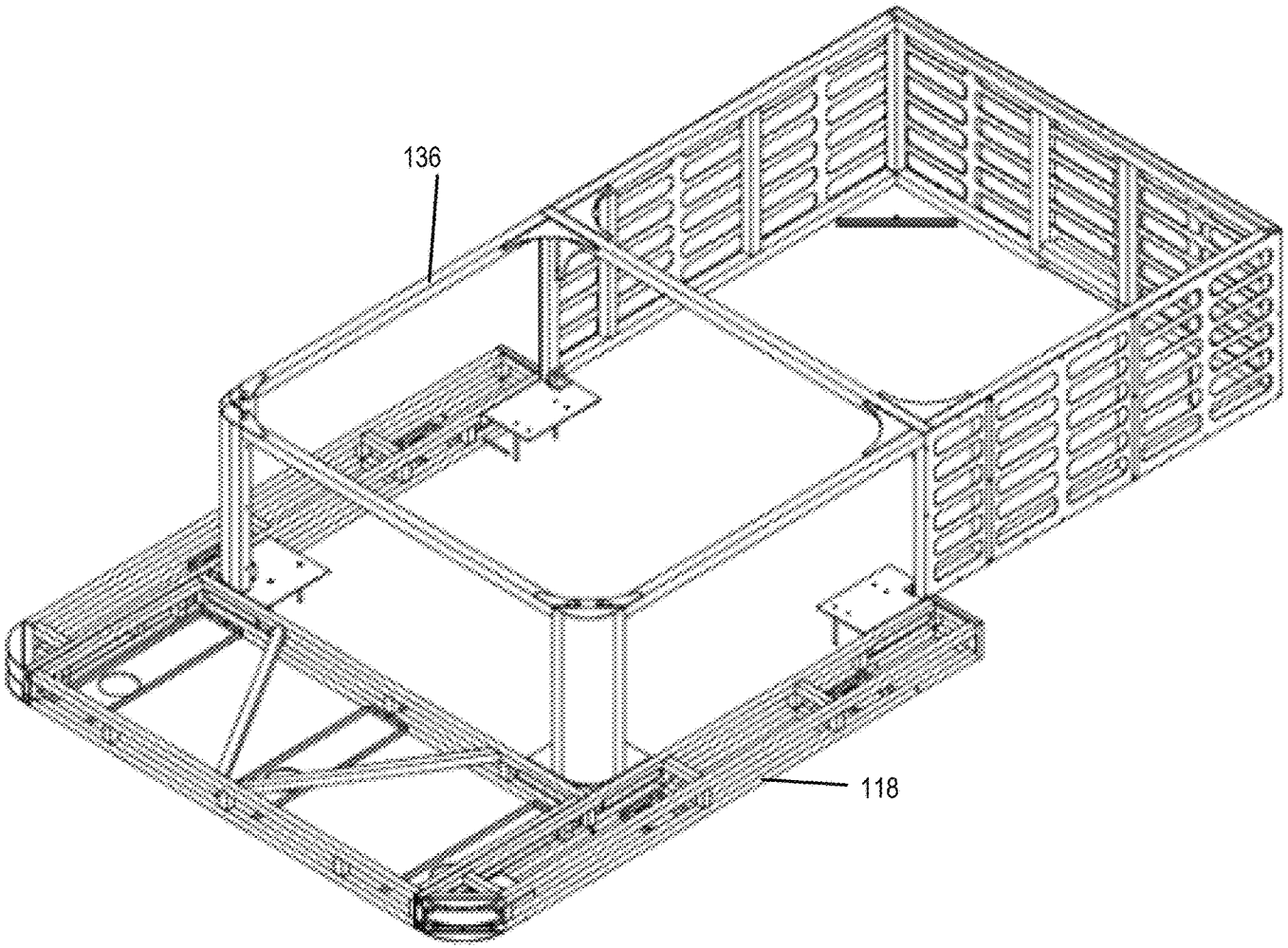
FIG. 19 shows the view of the awning and top hat of FIG. 18 with the outer cover removed to show structural elements.
Figure 20:
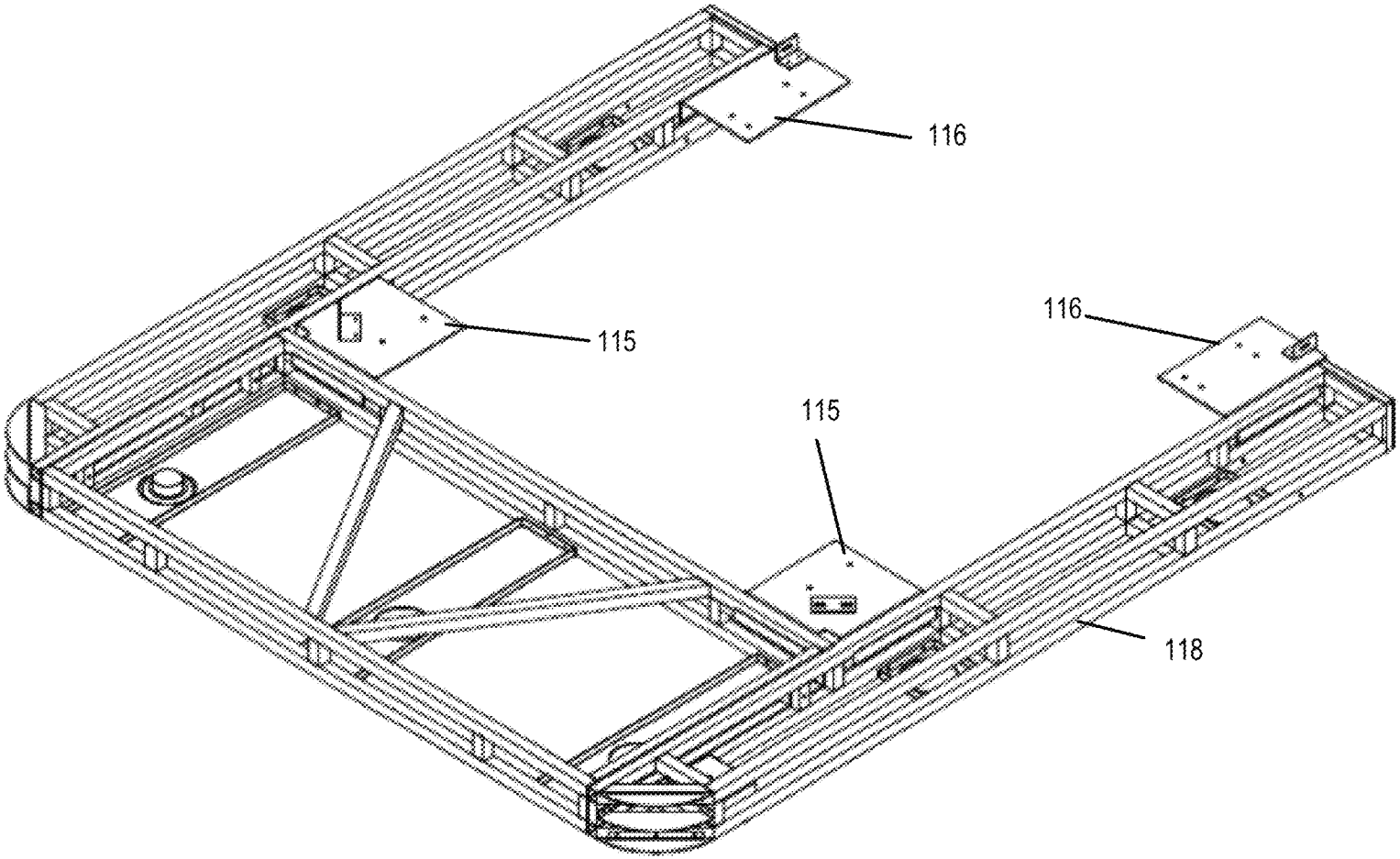
FIG. 20 shows a view of the awning of FIG. 15 with the outer cover removed to show structural elements.
Figure 21:
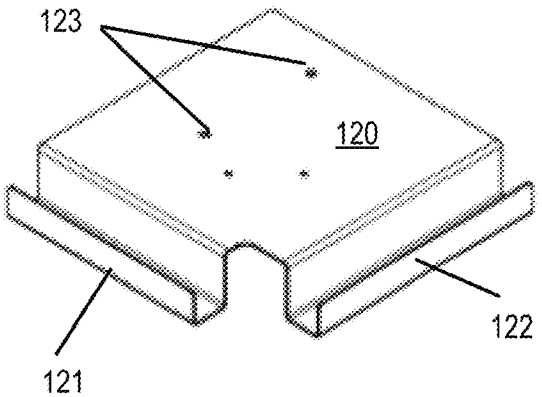
FIG. 21 shows a side bracket of the awning of FIG. 20.
Figure 22:
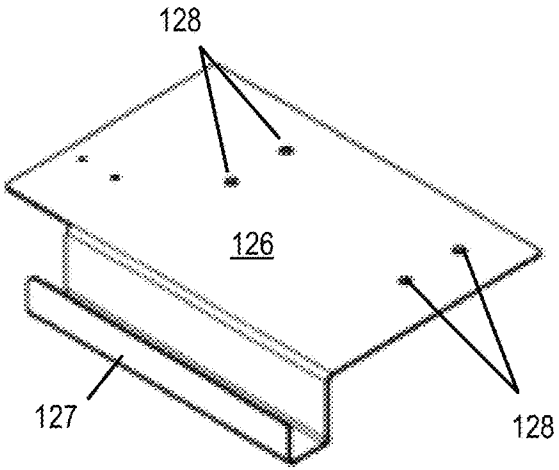
FIG. 22 shows a corner bracket of the awning of FIG. 20.
Figure 23:
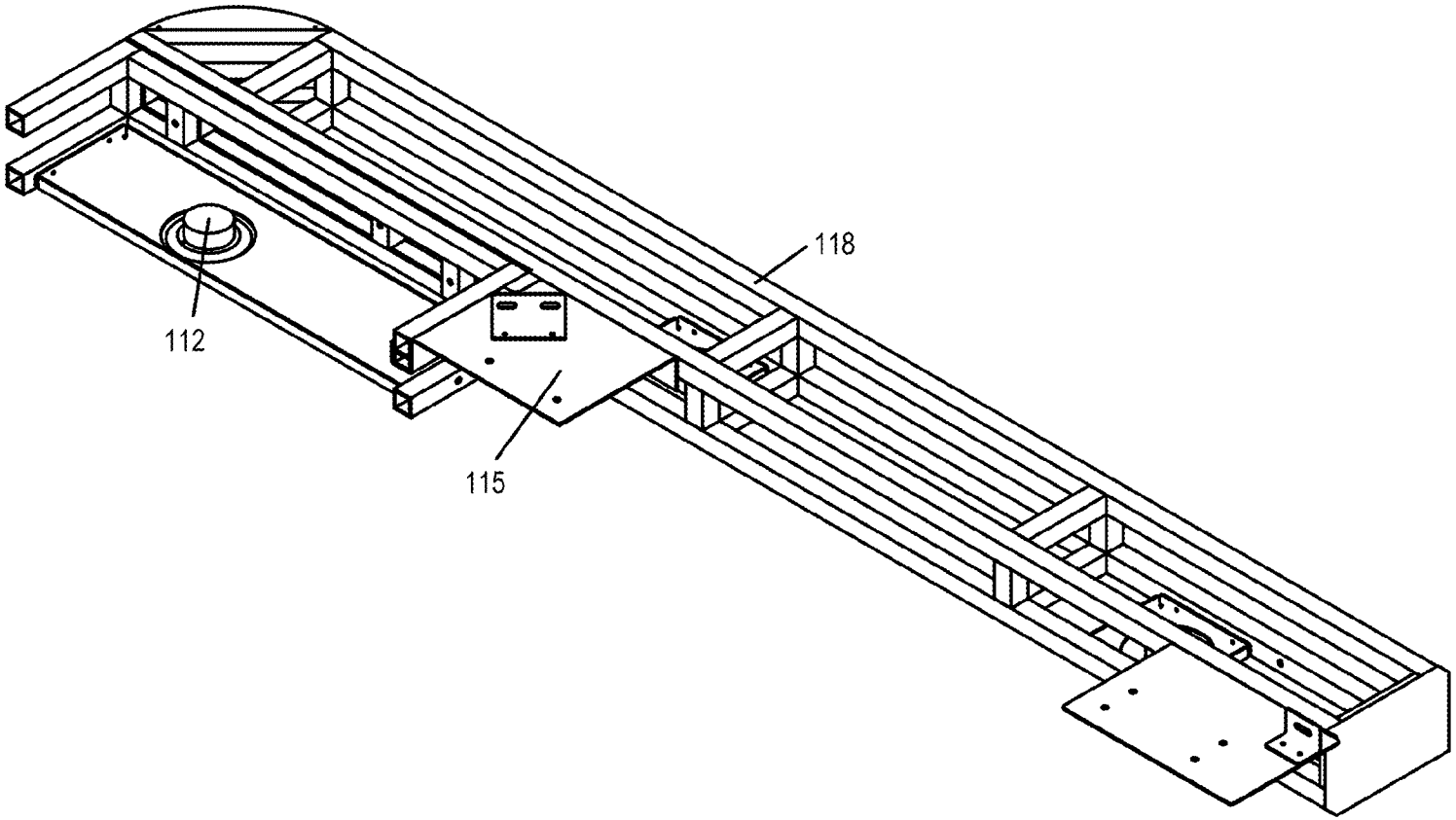
FIG. 23 shows a closer view of the corner bracket of FIG. 22 attached to the awning of FIG. 20.

A top hat 130 extends upward above the awning 110 and serves, in part, to hide the ice makers 140, 142 on top of the ice vending machine from customer view. The top hat 130 includes structurally supported removable and backlit polycarbonate graphics panels 132, 134 at the front and sides, respectively, of the ice vending machine above the awning 110. The panels 132, 134 are supported by a framework 136, as shown in FIG. 19.

Ice Maker Canopy

Figure 24:
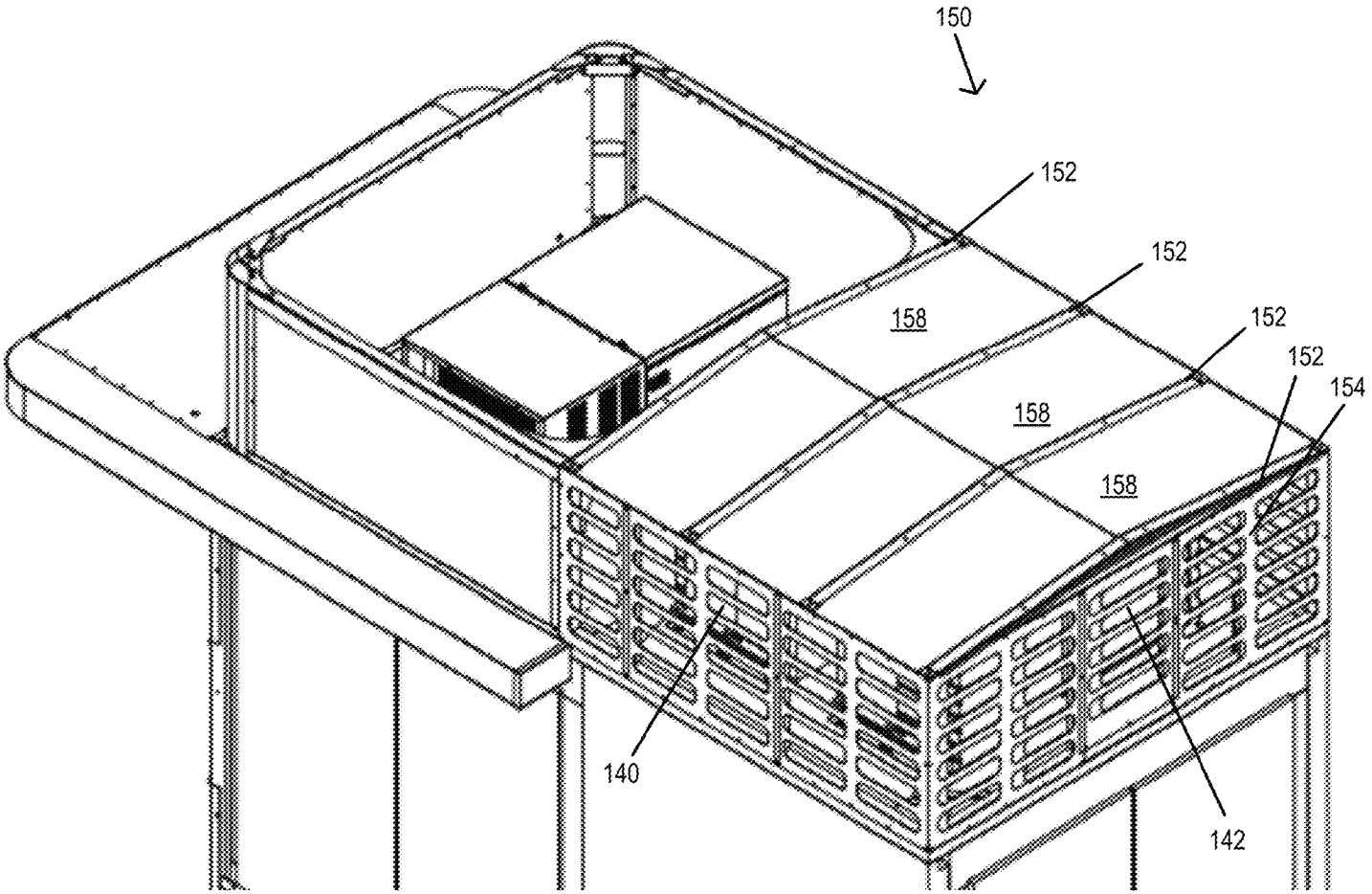
FIG. 24 shows a schematic elevated back view of an ice vending machine showing the brackets for an ice maker canopy in an embodiment of the present invention.
Figure 25:
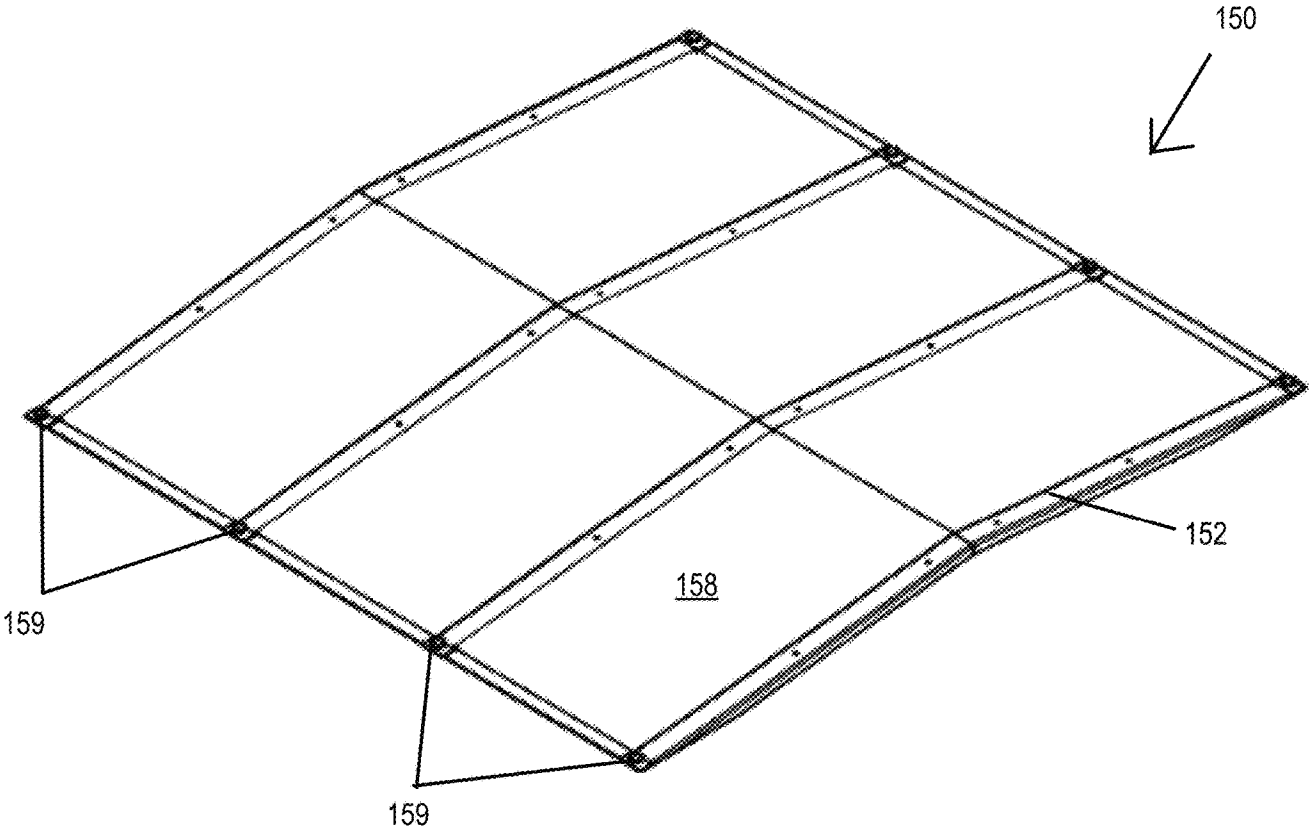
FIG. 25 shows a schematic elevated view of the ice maker canopy of the ice vending machine of FIG. 24.
Figure 26:
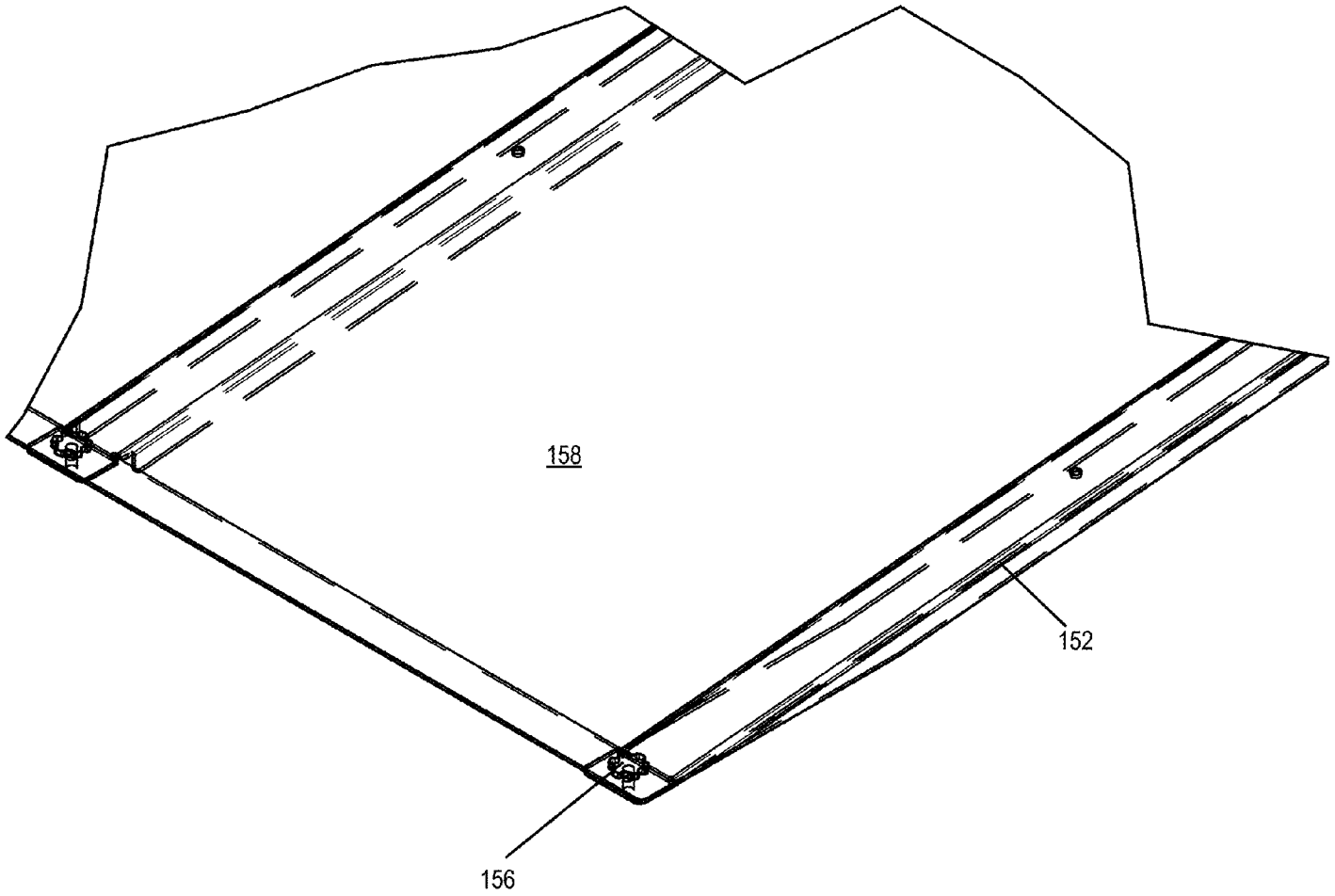
FIG. 26 shows a closer view of the corner of the ice maker canopy of FIG. 25 with a thumb screw.

Referring to FIG. 24, FIG. 25, and FIG. 26, the ice maker canopy 150 protects the ice makers 140, 142, located on top of the roof, from sun and rain. The ice maker canopy 150 includes the use of "A" frame cross members 152 mounted on top of the roof on the top hat vent panel structure 154. Although the design of FIG. 24 shows two ice makers 140, 142, the ice vending machine may have one, two, or more than two ice makers, with an "A" frame-like cross member 152 across each ice maker to protect it. A thumb screw 156 is used to mount the cross member 152 to the main frame of the ice vending machine. A complete framework is covered by fabric 158 with grommets 159 in it to allow the use of thumb screws 156 for easy installation and removal of the fabric. The fabric can also incorporate a few extra grommet holes 159 to let some rain water go through to prevent sagging of the fabric under the weight of the water.

Motor and Chain Layout

A conventional motor and chain layout includes an idler sprocket and three chains run by two motors. The rack and horizontal motor drives the first chain, which drives the rack. The sprocket to drive the rack also drives a second chain, which runs the horizontal auger and idler sprocket. The third chain is driven by a bin floor motor, which drives the horizontal conveyor along the bin floor.

Figure 27:
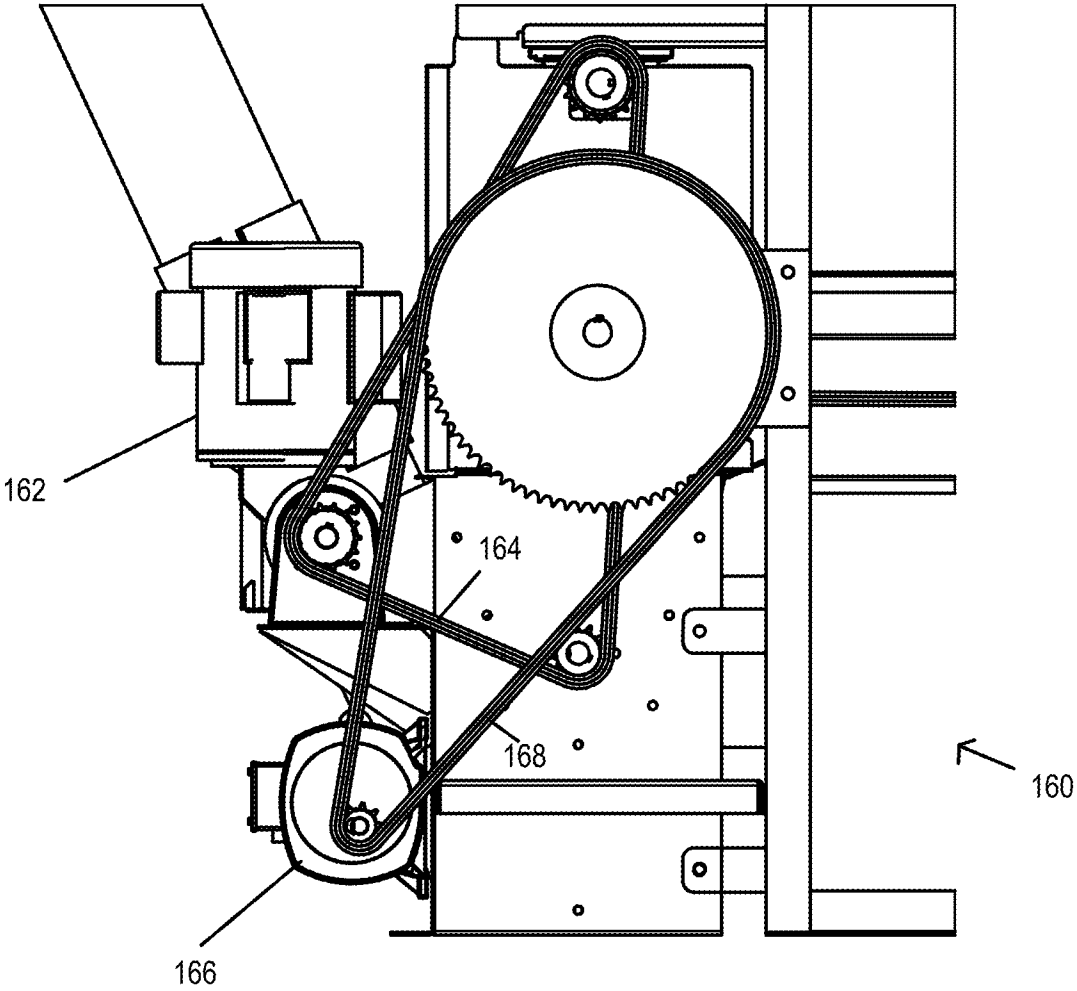
FIG. 27 shows a schematic side view of a motor and chain layout in an embodiment of the present invention.
Figure 28:
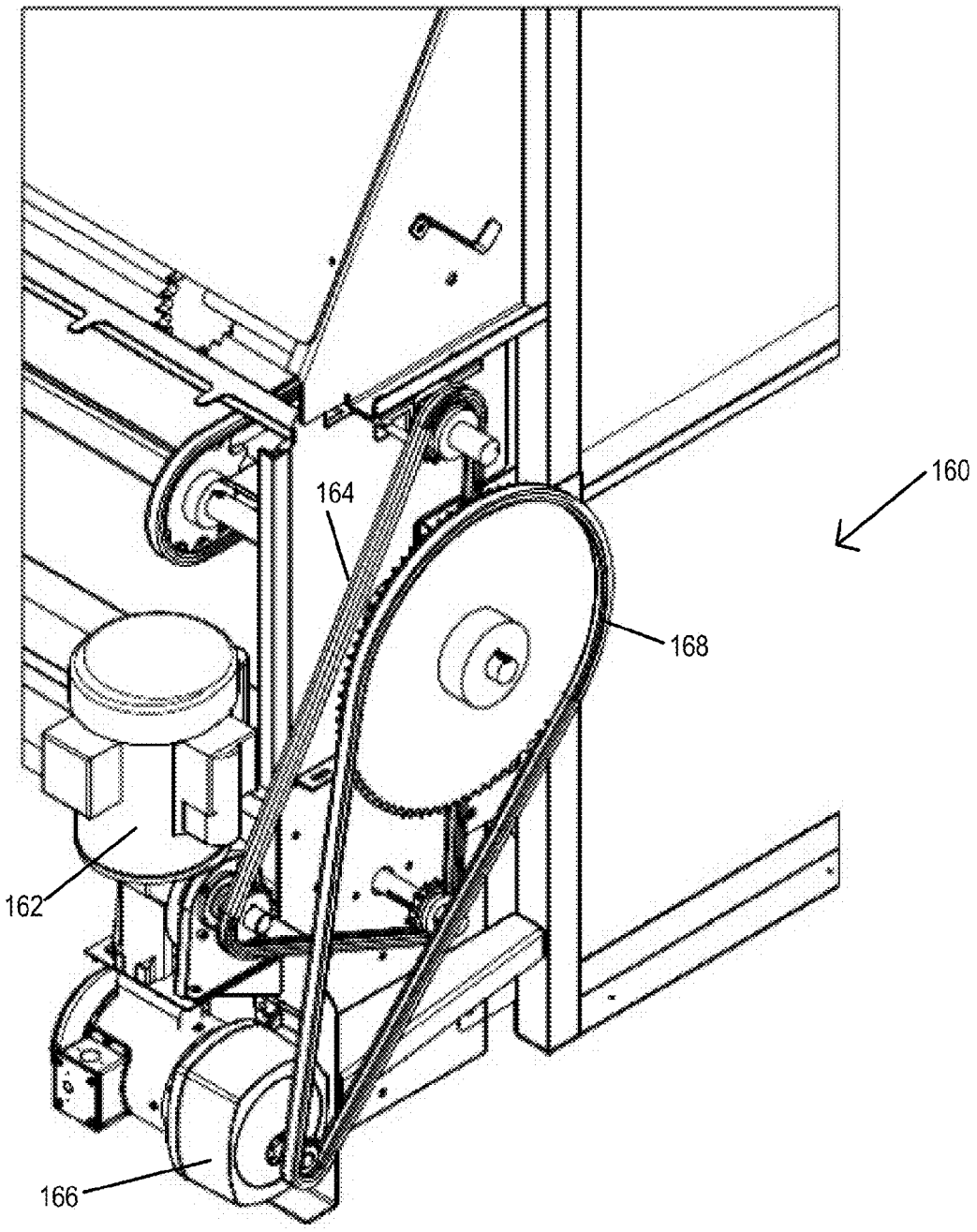
FIG. 28 shows a perspective view of the motor and chain layout of FIG. 27.

Referring to FIG. 27 and FIG. 28, the layout and position of the electric motor and chain design 160 integrates the advantage of a much simpler layout and installation and ease of access with fewer components compared to conventional layouts. The rack and horizontal motor 162 drives a first chain 164 to drive the rack and the horizontal auger. The bin floor motor 166 drives a second chain 168 to drive the horizontal conveyor along the bin floor. This layout eliminates the use of an idler sprocket and makes the layout simpler. Any chain adjustment, which conventionally has been done by movement of the idler sprocket, may be done by using the slots in the motor mounting brackets. Location of the rack and bin motors, which traditionally has been inside/towards the holding vessel, is now outside and away from the holding vessel, making servicing much easier.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An ice vending machine comprising:

an ice making apparatus that makes ice from a liquid water source;

an ice bagging apparatus comprising:

an ice bin with a vending end with an opening, a floor, side walls, a back wall wherein the back wall is opposite of the vending end and the ice bin holds ice made by the ice making apparatus;

a horizontal auger at the vending end of the ice bin that receives ice flowing from the opening in the vending end of the ice bin such that as the horizontal auger rotates it moves ice flows from the opening in the ice bin horizontally towards one side wall of the ice bin;

an inclined auger that receives ice and as it rotates moves ice flowing from the horizontal auger up into at least one vending bag wherein inclined auger includes a circular inclined auger pipe such ice moves up the inclined auger pipe as the inclined auger turns;

a transfer box that connects the horizontal auger and the inclined auger that includes a back wall, a side wall, an input wall that is perpendicular to the horizontal auger and has an opening that allows ice to mover from the horizontal auger into the transfer box and an angled face with a circular opening that receives the inclined auger pipe approximately perpendicular to the angled face; and a bag closing system that holds the vending bag open to receive ice and closes the vending bag when a specified amount of ice is loaded;

a user interface with inputs for selection of ice to be purchased and payment processing equipment; and a control board communicating with the user interface and the ice bagging apparatus to include ice movement into a vending bag and delivery of such bagged ice to a customer upon receive payment.

2. An ice vending machine of claim 1 wherein the transfer box is attached to the horizontal auger with bolts fitting through slots that allow the transfer box to be rotated slightly to adjust for variations in the inclined auger angle and then for the transfer box to be held in a specific location when the bolts are tightened.

3. An ice vending machine of claim 1 wherein the inclined auger includes an inclined auger motor mounted at the top of the inclined auger.

4. The ice vending machine of claim 3, wherein the inclined auger motor drives the inclined auger by way of a chain and sprockets.

5. The ice vending machine of claim 3, wherein the inclined auger motor directly drives the inclined auger without a chain or sprockets.

6. An ice vending machine of claim 1 wherein the ice bin includes a lip shelf at an edge of the ice bin above the vending opening that extends the length of the vending opening yet allows appropriate quantities of ice to flow to the horizontal auger, but is sized to limit large blocks or quantities of ice from entering the horizontal auger at one time.

7. An ice vending machine of claim 1 wherein the rear wall of the ice bin is removable and secures to flanges located on exterior of the sides walls of the ice bin such that the fasteners securing the rear wall are exterior to the ice bin and do not contact ice within the ice bin.

* * * * *